US005711460A

United States Patent [19]

Saito et al.

[11] Patent Number: 5,711,460

[45] Date of Patent: Jan. 27, 1998

[54] TRIGGER TYPE LIQUID DISCHARGE DEVICE

[75] Inventors: Tadao Saito; Shigeru Hayakawa, both of Tokyo, Japan

[73] Assignee: Yoshino Kogyosho Co., Ltd., Tokyo, Japan

[21] Appl. No.: 666,431

[22] PCT Filed: Oct. 26, 1995

[86] PCT No.: PCT/JP95/02203

§ 371 Date: Jun. 25, 1996

§ 102(e) Date: Jun. 25, 1996

[87] PCT Pub. No.: WO96/13334

PCT Pub. Date: May 9, 1996

[30] Foreign Application Priority Data

Oct. 26, 1994 [JP] Japan ..... 6-285923

[51] Int. Cl.[6] ..... B67D 5/40

[52] U.S. Cl. ..... 222/380; 222/383.1

[58] Field of Search ..... 222/380, 383.1, 222/496, 494; 239/333

[56] References Cited

U.S. PATENT DOCUMENTS 4,227,650 10/1980 McKinney ..... 222/380
4,313,568 2/1982 Shay ..... 239/333
4,313,569 2/1982 Burke ..... 222/380
4,358,057 11/1982 Burke ..... 222/380
4,819,835 4/1989 Tasaki .

FOREIGN PATENT DOCUMENTS

U-4-17855 2/1992 Japan .

*Primary Examiner*—Philippe Derakshani
*Attorney, Agent, or Firm*—Oliff & Berridge, PLC

[57] ABSTRACT

A trigger type liquid discharge device is provided with a valve structure designed to open only when the liquid inside the device shows a proper discharge pressure and arranged upstream relative to the discharge aperture of the nozzle head thereof and also with a flow path arranged in the cylinder of the pump unit of the device for returning any residual pressure in the liquid flow paths of the device after the end of a liquid discharging cycle. With such an arrangement, it can effectively prevent liquid from dripping out of the discharge aperture because of the residual pressure in the liquid flow paths in the initial and/or final stages of the liquid discharging operation.

15 Claims, 29 Drawing Sheets

TRIGGER TYPE LIQUID DISCHARGE DEVICE

FIELD OF THE INVENTION

This invention relates to an improved trigger type liquid discharge device to be fitted to an opening of a liquid container containing liquid in order to discharge the liquid.

PRIOR ART

FIG. 33 of the accompanying drawings illustrates a known trigger type liquid discharge device disclosed in U.S. Pat. No. 4,819,838 and so designed as to be fitted to the opening of a liquid container containing liquid in order to discharge the liquid.

In the known trigger type liquid discharge device as disclosed in U.S. Pat. No. 4,819,888, a pump unit E is arranged in parallel with a horizontally disposed discharge pipe unit F as illustrated in FIG. 33.

The trigger type liquid discharge device as illustrated in FIG. 33 is provided with a fitting section 101 by which the liquid discharge device is secured to an opening of a liquid container. When a trigger 102 of the device is pushed in a direction indicated by arrow J', a pushing member 103 by turn depresses a transversal groove 105 of a head 104 of piston unit G of the device so as to move a piston I until an end face 106 of the piston I abuts a bottom wall 107 of a cylinder H. Thus, the liquid liquid filled in a cylinder chamber 108 is pushed out of the device through a liquid suction/discharge port 109 to a liquid flow path 110 so as to push a discharge valve body 111 under its pressure.

The discharge valve body 111 has a reslliently deformable section 112, which is resiliently deformed under the pressure of the liquid to open discharge valve seat 113. Thus, liquid is allowed to flow into a flow path 115 of the discharge pipe F through discharge valve chamber 114. Then the liquid flows into an another flow path 116 and then a shallow groove M arranged between a liquid guide L and a short pipe K of a nozzle head J. Then, the liquid flows into a still another flow path 117 in which spins the liquid, and is finally discharged through a discharge aperture 118.

Meanwhile, the piston I compresses a spring 119 contained in the piston unit. A ball valve 120 also contained in the unit is forced to abut a suction valve seat 121 under the pressure applied by the liquid of the flow path 110.

After completing to discharge the liquid through the discharge aperture 118, and if the trigger 102 is released, the piston is returned to a position shown in FIG. 33 by the resilient force of the spring 119 to expand the cylinder chamber 108 so as to generate a negative pressure in the chamber 108. Such negative pressure acts on the discharge valve body 111 and the ball valve 120 to cause the discharge valve body 111 to firmly abut and close the discharge valve seat 113. Consequently, the ball valve 120 is moved away from the suction valve seat 121 to allow liquid in the liquid container to flow through a suction pipe 122, the liquid flow path 110 and the port 109 into the cylinder chamber 108 so that the device ready is made for another discharge operation.

The cylinder H is provided in a part of its peripheral wall with an air intake port 123. The air intake port 123 is held in communication with the liquid container, on which the device is mounted by means of the fitting section 101 of the device, through air ducts 124 and 125.

The piston I has a stroke end side resilient annular skirt 126 extending toward the bottom wall 107 of the cylinder H and an approach end side resilient annular skirt 127 extending toward the opening of the cylinder H. Said annular skirts 126 and 127 are held in close contact with the inner wall of the cylinder.

When the piston I is located in a stroke end position where the end surface 106 abuts the bottom wall 107 of the cylinder H, an edge 128 of the approach end side annular skirt 127 is positioned beyond the air intake port 123 of the cylinder H toward the bottom wall 107. Under this condition, air is introduced into the liquid container as the air intake port 123 communicates with an opening 129 of the cylinder H that is exposed to the atmosphere. If, to the contrary, the piston I is located at an approach end position as indicated in FIG. 33, the air intake port 123 is closed as it is positioned between the two annular skirts 126 and 127 so that no liquid would flow out through the air intake port 123 if the liquid container is tumbled down by mistake.

The trigger type liquid discharge device as disclosed in U.S. Pat. No. 4,819,835 and summarily described above functions correctly so long as a user uses it properly and operates the trigger in such a way that the piston completely moves from the stroke end position to the approach end position.

In FIG. 33, reference symbol N denotes a cap for covering the discharge aperture 117 and reference symbol O denotes a pivot of the cap N.

While the trigger type liquid discharge device as disclosed in U.S. Pat. No. 4,819,835 operates satisfactorily efficiently for discharging liquid, it is accompanied by certain drawbacks particularly in terms of the pressure of the liquid flowing from the cylinder chamber 108 to the discharge aperture 118 during liquid discharging operation. More specifically, referring to FIG. 34, during time TS from when the piston I starts moving from the approach end toward the stroke end, the liquid pressure PS in the shallow groove M and the flow path 117 which constitutes a spinning groove does not rise high enough to give rise to a jet stream of liquid. During time TE from the end of a liquid discharge phase when the piston I reaches to the stroke end and stops discharging liquid, residual pressure PE is found over a large area including the cylinder chamber 108, the port 109, the liquid path 110 and the discharge chamber 114.

As a result, liquid may drip out from the discharge aperture 118 at the beginning and the end of a discharge phase. When liquid is discharged as foam, large bubbles of liquid that have not sufficiently foamed may come out through the aperture. The trigger type liquid discharge device of the prior art has such drawbacks.

SUMMARY OF THE INVENTION

It is therefore an object of the present invention to provide a trigger type liquid discharge device having a configuration substantially as shown in FIG. 33 and improved such that no liquid drips out through the discharge aperture of the device even in the initial and final stages of the operation of activating the trigger and still the device satisfactorily operates for discharging liquid.

According to the invention of the claim 1, the above object is achieved by providing a trigger type liquid discharge device wherein a valve structure is arranged on the upstream side of the discharge aperture that is opened exactly when the internal liquid pressure gets to a predetermined discharge pressure so as to prevent any discharge of liquid through the discharge aperture until the internal liquid pressure gets to the predetermined discharge pressure.

According to the invention of the claim 2, the above object is achieved by providing a trigger type liquid discharge device wherein a liquid pressure relief mechanism which returns any residual liquid pressure in the liquid flow path to the liquid container is provided on the pump unit of the device for pumping up liquid from the container to the liquid discharge device, so as to to prevent liquid from dripping out in the initial and final stages of liquid discharging operation.

According to the invention of the claim 3, the above object is achieved by providing a trigger type liquid discharge device having a valve structure on the upstream side of the discharge aperture and a liquid pressure relief mechanism on the pump unit of the device wherein the valve structure opens exactly when the internal liquid pressure gets to a predetermined discharge pressure and wherein the liquid pressure relief mechanism returns any residual liquid pressure in the liquid flow path to the liquid container to prevent liquid from dripping out in the initial and final stages of liquid discharging operation.

According to the invention of the claim 4, the trigger type liquid discharge device is constructed such that it is prevented to excessively decrease the pressure in the container due to the reciprocation of the pump mechanism.

According to the invention of the claim 5, the trigger type liquid discharge device is improved so that it is easy to form the valve construction.

According to the invention of the claim 6, the above object is achieved by providing a trigger type liquid discharge device wherein the residual pressure in the area from the liquid flow path to pump mechanism can be removed by using the outer surface of the inner sleeve which receives the spring and is arranged in the cylinder of the pump mechanism.

According to the invention of the claim 7, the above object is achieved by providing a trigger type liquid discharge device wherein the residual pressure in the pump mechanism can be removed by using the liquid flow path which is arranged out of the pump mechanism. Thus, it is easy to design the mechanism to suck the air.

According to the invention of the claim 8, the above object is achieved by providing a trigger type liquid discharge device wherein the tolerance of the cylinder and the piston etc. of the pump mechanism does not affect the removal of the residual pressure from the pump mechanism.

According to the inventions of the claims 9–15, a trigger type liquid discharge device for the use condition is provided by combining the valve construction and the pump mechanism as described above.

THE PREFERRED EMBODIMENTS

Figure 32:
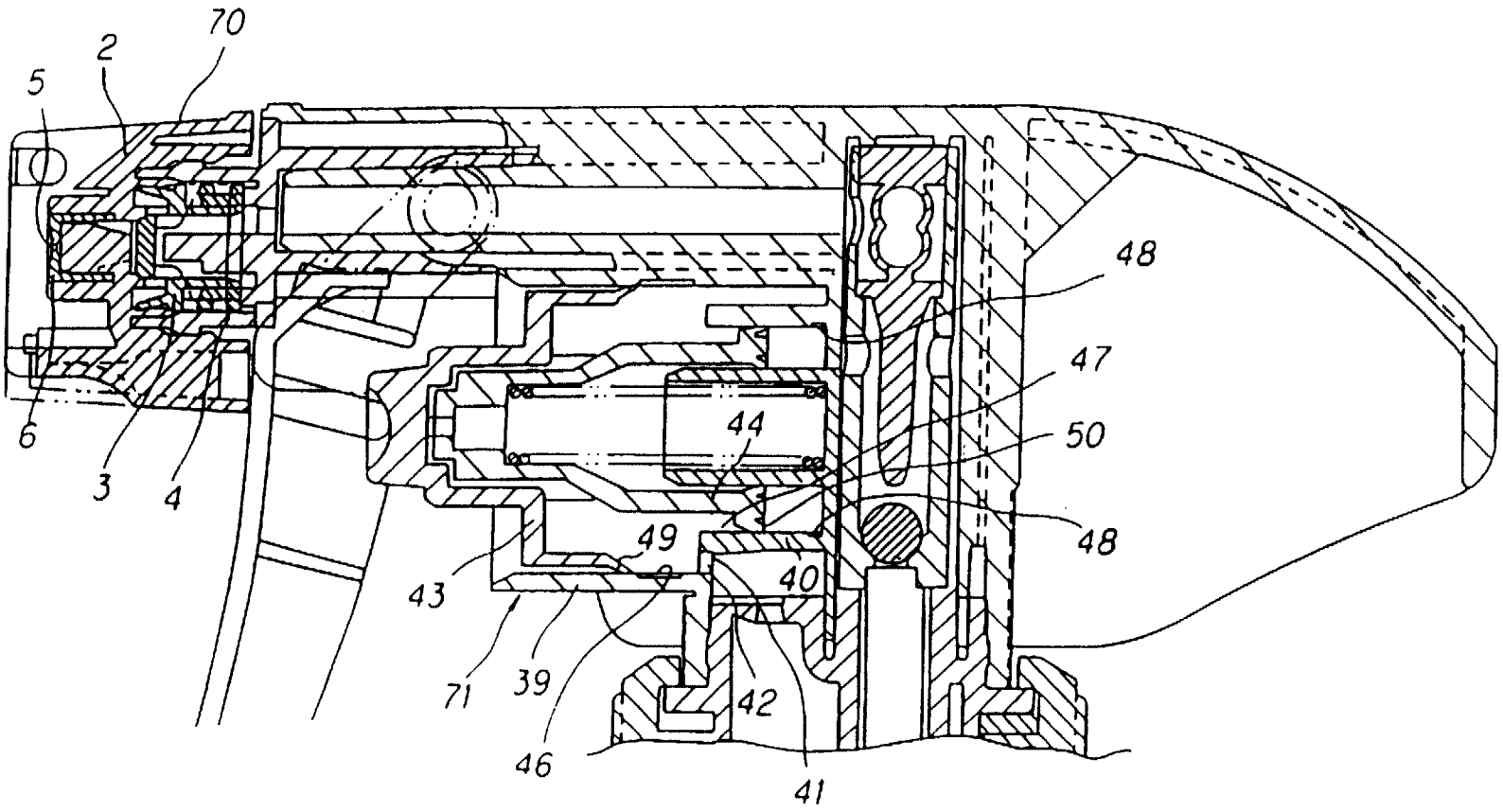
FIG. 32 is an enlarged longitudinal sectional view of an embodiment of the liquid discharge device according to the invention of the claim 3, showing a principal part thereof.
Figure 33:
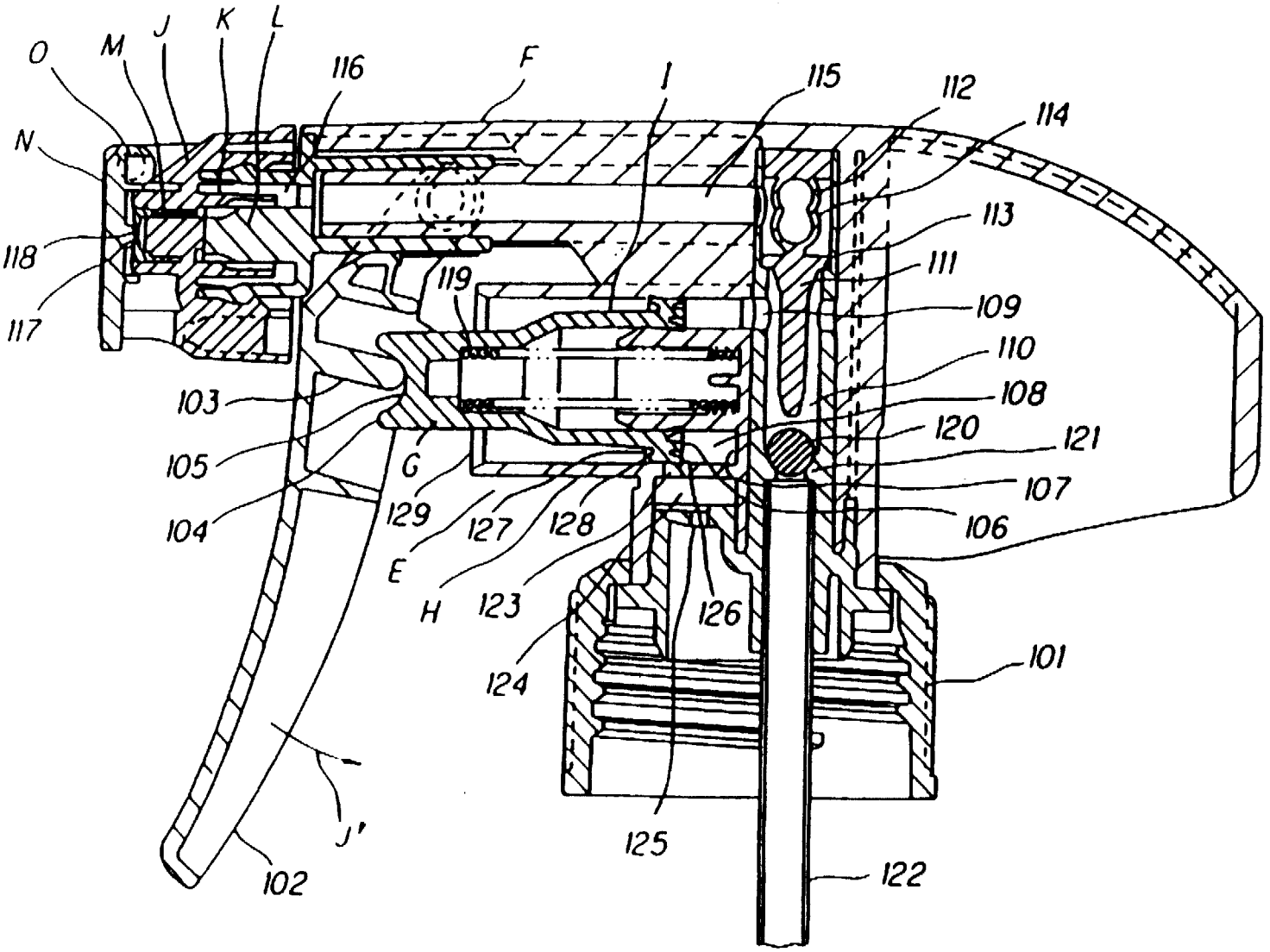
FIG. 33 PRIOR ART
FIG. 33 is an enlarged longitudinal sectional view of a conventional trigger type liquid discharge device.

For the purpose of the present invention, all the components of a trigger type liquid discharge device according to the invention operate similarly as their counterparts of a conventional trigger type liquid discharge device illustrated in FIG. 33 and described above except the nozzle head section and the pump unit. Thus, those components that are similar to or same as their counterparts of FIG. 33 should be referred. Throughout FIGS. 1 to 32, same and identical components are denoted by same reference symbols.

FIGS. 1 through 8 illustrate in enlarged views a nozzle head section 1 of a first embodiment of liquid discharge device according to the claim 1. The nozzle head section 1 comprises a nozzle head 2, a liquid guide 3, a spin element 4 and a nozzle tip 6 having a discharge aperture 5.

The nozzle head 2 is provided with a valve .seat 8 arranged in a liquid flow path 7 at a position upstream relative to the discharge aperture 5. Said liquid flow path 7 communicates with the liquid flow path 115 of the discharge pipe unit F via a liquid flow path 9.

As shown in FIGS. 4 through 7, said liquid guide 3 comprises a valve body 10 which abuts on the valve seat 8 to close the liquid flow path 7, a pressure bearing sleeve 11 integrally formed with the valve body 10, an anchoring member 12 to be secured to the spin element 4 and a spring member 13 for coupling the discharge valve 10 and the pressure bearing sleeve 11 to the anchoring member 12.

Figure 5:
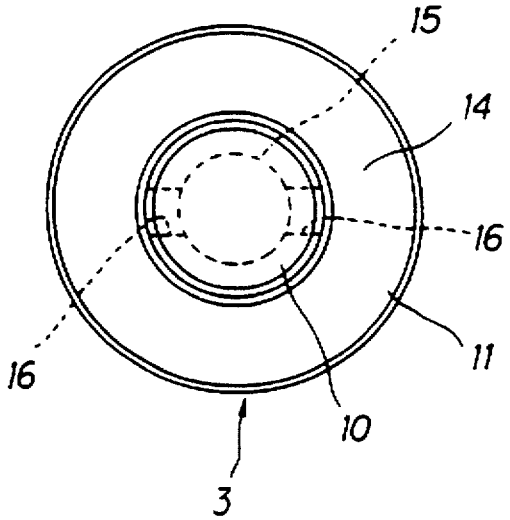
FIG. 5 is a front view of the integral structure of FIG. 4.
Figure 6:
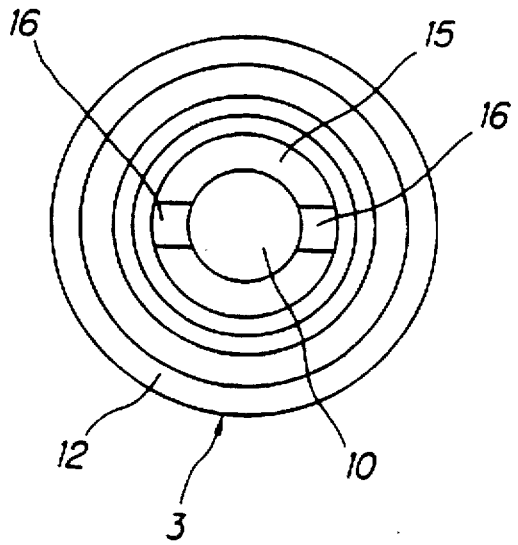
FIG. 6 is a rear view of the integral structure of FIG. 4.
Figure 7:
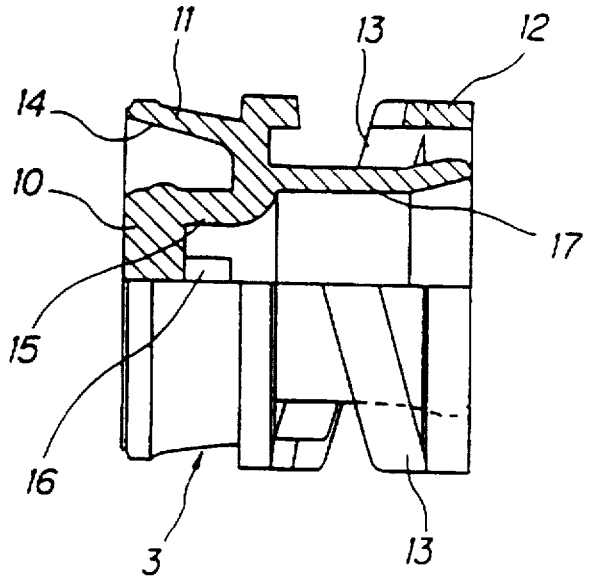
FIG. 7 is an enlarged partially sectional lateral view of the integral structure of FIG. 4, obtained by rotating it by 90° from the position of FIG. 4.

As shown in FIGS. 5 and 7, the pressure bearing sleeve 11 has a pressure bearing surface 14 arranged to face the upstream side of the liquid flow path 7 for bearing liquid pressure.

Figure 1:
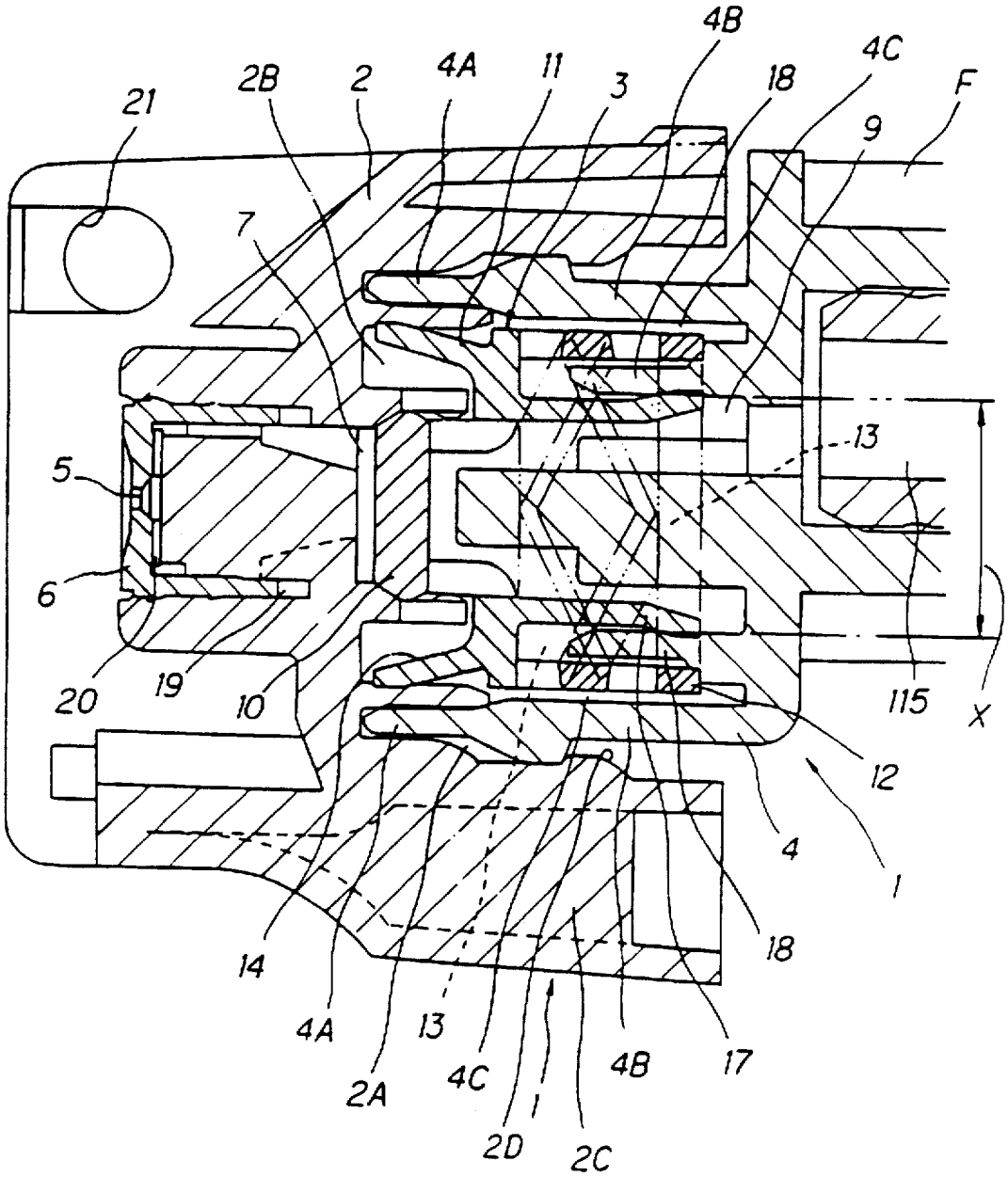
FIG. 1 is an enlarged longitudinal sectional view of a first embodiment of liquid discharge device according to the invention of the claim 1, showing the inside of the device before it starts discharging liquid.
Figure 2:
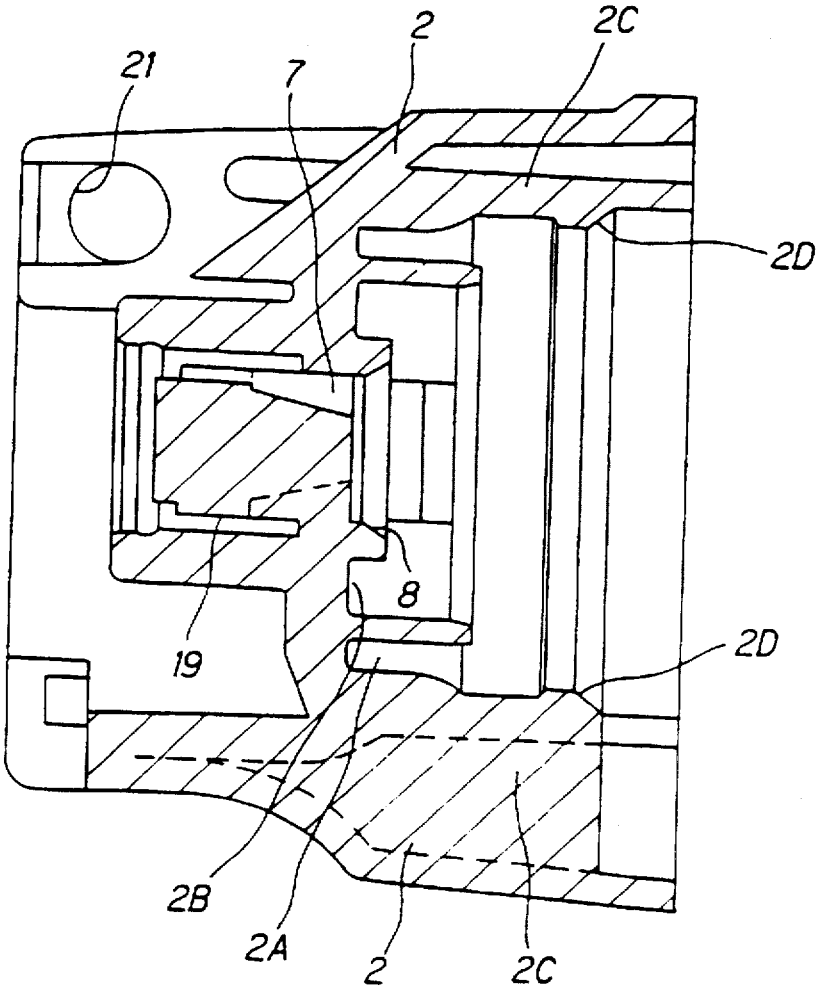
FIG. 2 is an enlarged longitudinal sectional view of the nozzle head of the embodiment of FIG. 1.
Figure 3:
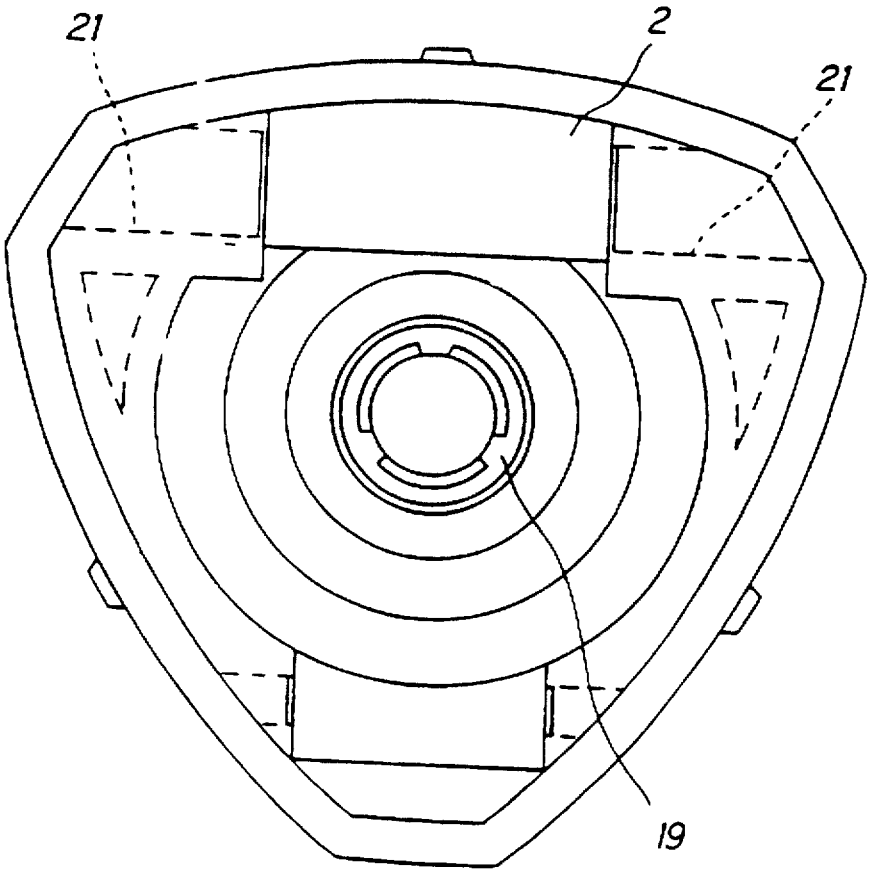
FIG. 3 is an enlarged front view of the nozzle head of FIG. 2.
Figure 4:
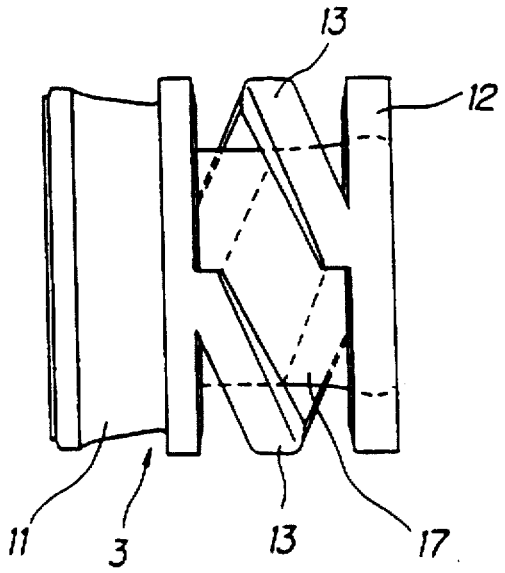
FIG. 4 is an enlarged lateral view of an integral structure comprising a valve body a pressure bearing sleeve, an anchoring member and a spring member as shown in FIG. 1.

As seen from FIGS. 5 through 8, the valve body 10 and the pressure bearing sleeve 11 is coupled by means of a sleeve 15 provided with a window 16 which communicates to the liquid flow path 9. As shown in FIG. 1, the pressure of the liquid is applied to the liquid bearing surface 14 when the valve body 10 abuts the valve seat 8 to block the liquid flow paths 7 and 9.

Said sleeve 15 is integrally formed with a guide sleeve 17 extending to the side of the liquid flow path 9. Said guide sleeve 17 is slidably inserted into the inside of a guide sleeve 18 of the spin element 4 projecting toward the liquid flow path 7, such that it may slidably move without encountering any significant resistance and hence the valve body 10 may move back and forth relative to the valve seat 8, keeping its proper posture. The anchoring member 12 and the spring member 13 are arranged in an annular space 4C between the guide sleeve 18 and an outer sleeve 4B of the spin element 4.

As seen from FIGS. 1, 2, 3 and 8, the nozzle head 2 has a recess 19 at the front end thereof for bearing and securing or holding the nozzle tip 6 in such a way that a flow path 20 is produced in the form of a spin groove.

Reference numeral 21 in the drawings denotes a bore for bearing the pivot 0 of the cap N shown in FIG. 33.

The nozzle head 2 is provided with an annular groove 2A for bearing a corresponding annular section 4A of the front end of the spin element 4, and an another annular groove 2B for tightly but slidably bearing the pressure bearing sleeve 11.

The nozzle head 2 is so designed that, after fitting the liquid guide 3 thereinto, an outer sleeve 2C is secured to the spin element 4 by means of undercuts 2D. Thus, these are easily assembled.

Referring to FIG. 1, the valve body 10 is pressed against the valve seat 8 in FIG. 1 under liquid pressure applied thereto within the horizontal projection surface area X and by the resilient force of the spring member 13.

On the other hand, the pressure bearing sleeve 11 is pressed toward the upstream of the liquid flow paths under liquid pressure applied to the horizontal projection surface area of the pressure bearing surface 14.

Therefore, by selecting an appropriate value for the horizontal projection surface area of the pressure bearing surface 14 such that the force generated by the proper liquid discharge pressure that is applied to said horizontal projection surface area of the pressure bearing surface 14 is greater than the sum of the force generated by the proper liquid discharge pressure that is applied to the horizontal surface area of the valve body 10 and the resilient force of the spring member 13. the valve body 10 is moved and opened under liquid pressure the instance when the liquid pressure reaches the level of the proper liquid discharge pressure.

Figure 8:
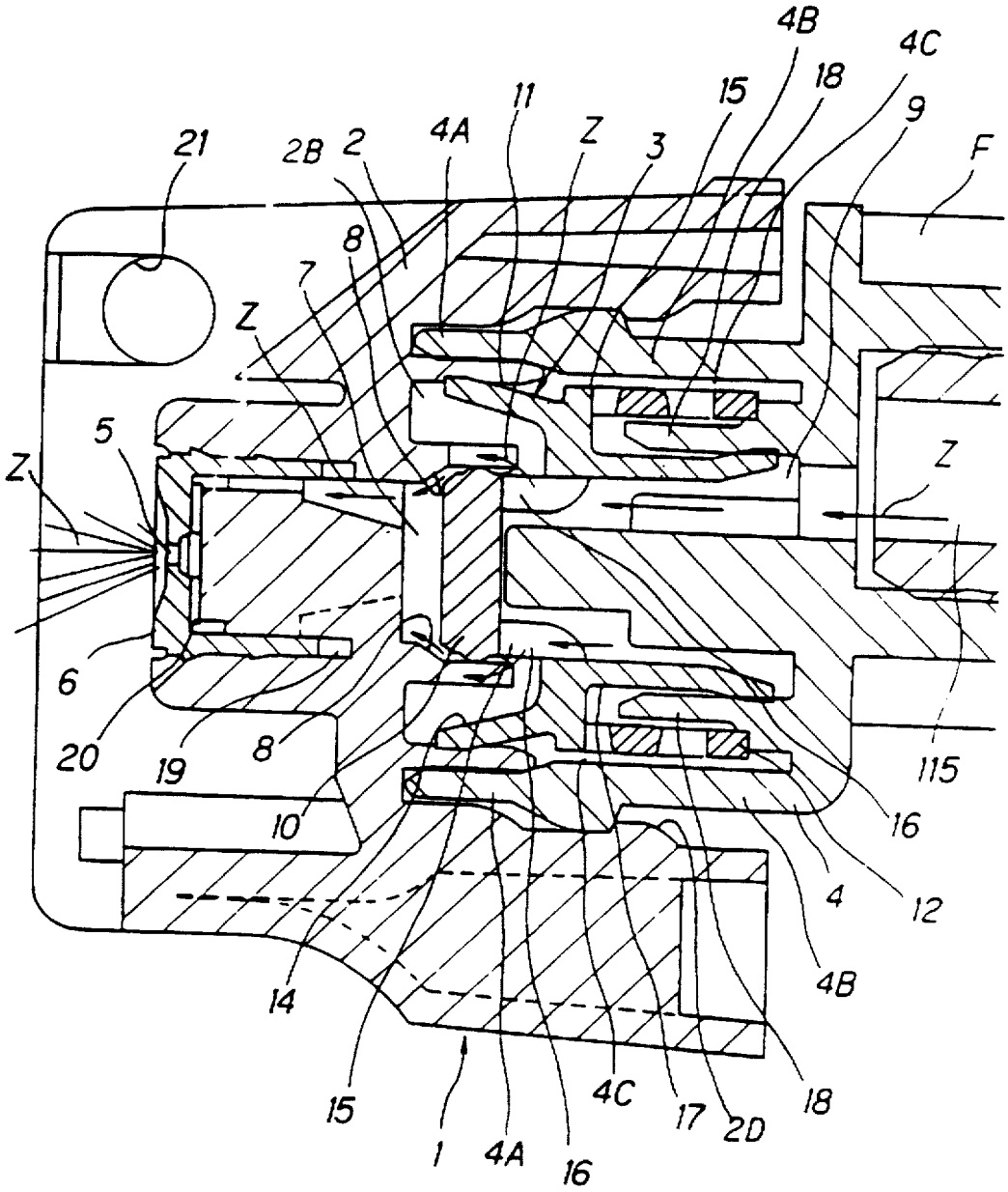
FIG. 8 is an enlarged longitudinal sectional view of the embodiment of FIG. 1, showing the inside when it is discharging liquid.
Figure 9:
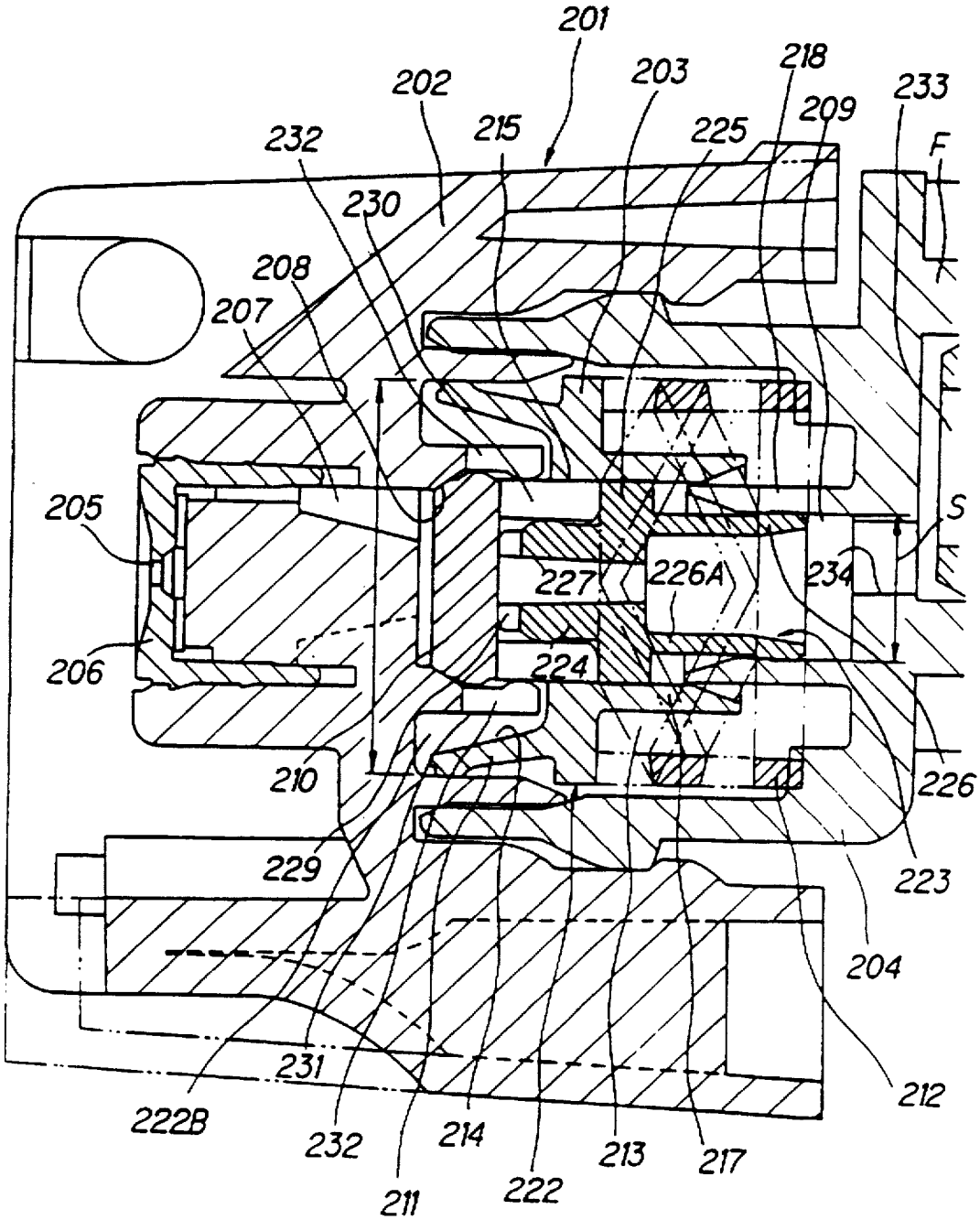
FIG. 9 is an enlarged longitudinal sectional view of a second embodiment of liquid discharge device according to the invention of the claim 1, showing the inside of the device before it starts discharging liquid.
Figure 34:
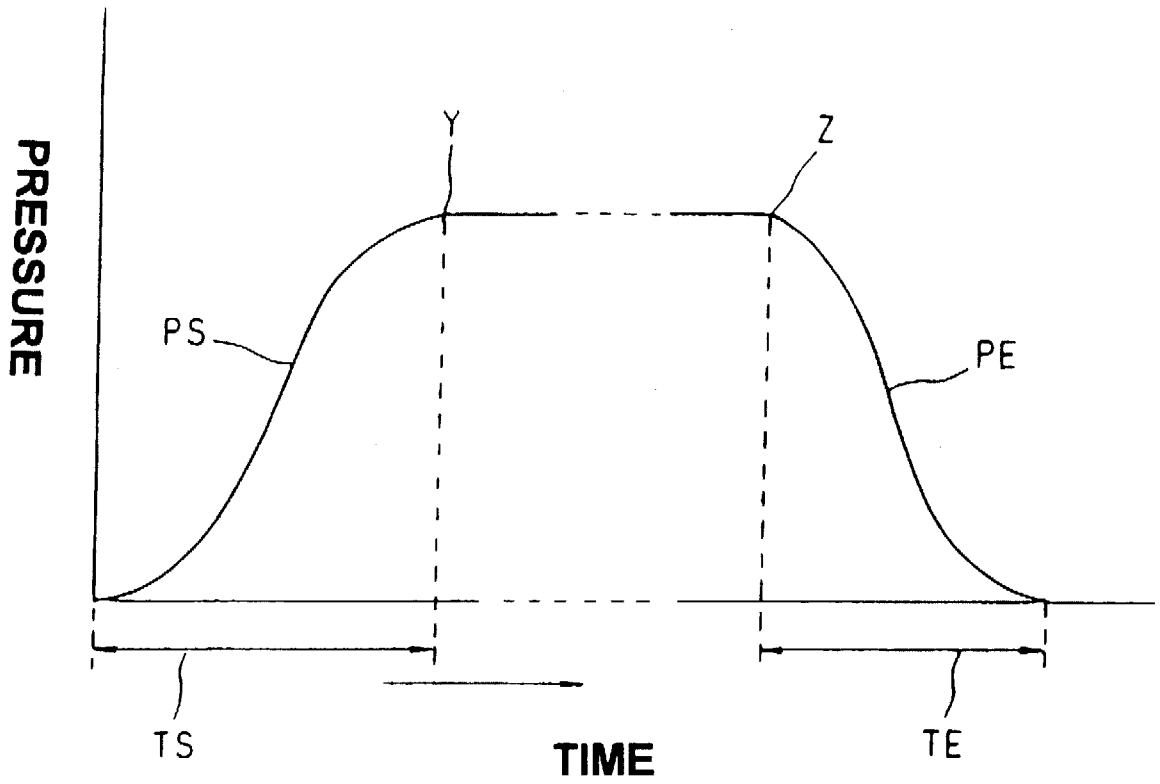
FIG. 34 is a graph showing the relationship between the elapsed time and the discharge pressure in an entire phase of operation of a trigger type liquid discharge device as shown in FIG. 25.

Thus, according to the invention of the claim 1, the valve body 10 is opened when the liquid pressure reaches the proper liquid discharge pressure Y as shown in FIG. 34 so that liquid is discharged in the direction indicated by arrow Z in FIG. 8. The valve body is closed when the liquid pressure falls under the proper liquid discharge pressure. With such an arrangement, liquid can be effectively prevented from dripping out of the discharge aperture 5 in the initial and final stages of discharging liquid due to insufficient liquid pressure.

FIGS. 9 through 15 shows, in an enlarged scale, the nozzle head 201 of a second embodiment of liquid discharge device according to the invention of the claim 1. While the nozzle head of the above described first embodiment comprises a one-piece liquid guide 3, the liquid guide 203 of the second embodiment comprises two pieces of an outer member 222 including a valve body 210 and an inner member 223.

Note that the nozzle head 202 including the nozzle tip 206 of this embodiment is otherwise structurally same as its counterpart of the first embodiment.

Figure 10:
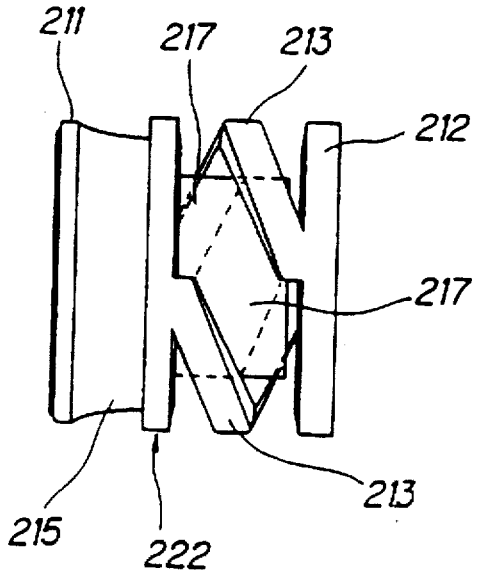
FIG. 10 is an enlarged lateral view of an outer member of the liquid guide of the embodiment of FIG. 9.
Figure 11:
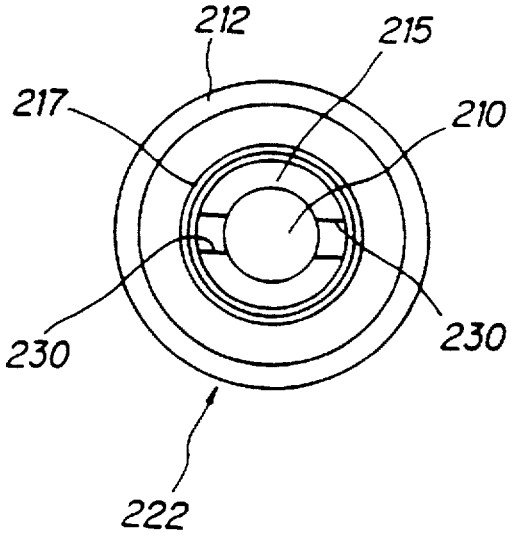
FIG. 11 is a rear view of the member of FIG. 10.
Figure 12:
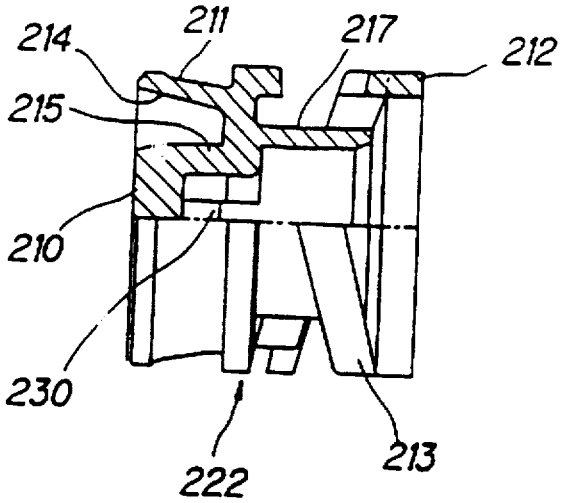
FIG. 12 is a lateral partially sectional view of the member of FIG. 10, obtained by rotating it by 90° from the position of FIG. 10.

As shown in FIGS. 10, 11 and 12, the outer member 222 of the liquid guide 203 comprises a valve body 210, a pressure bearing sleeve 211, an anchoring member 212 to be secured to the spin element 204, a spring member 213 and a guide sleeve 217.

The valve body 210 blocks the liquid flow path 207 arranged on the side of the nozzle tip 206 and the upstream side liquid flow path 209.

The spring member 213 couples the anchoring member 212 to the valve body 210, the pressure bearing sleeve 211 and the guide sleeve 217.

Figure 13:
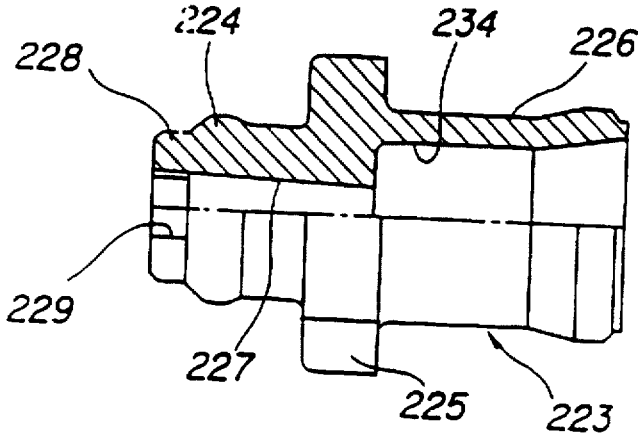
FIG. 13 is an enlarged lateral partially sectional view of an inner member of the liquid guide of the embodiment of FIG. 9.
Figure 14:
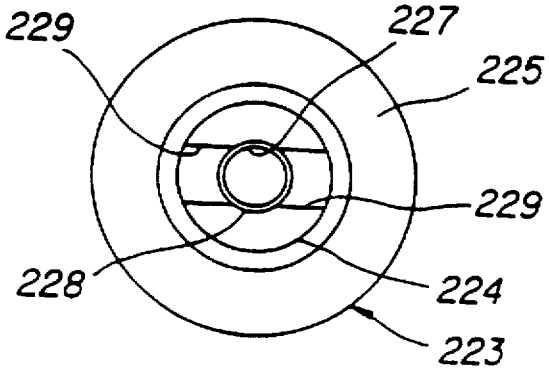
FIG. 14 is a front view of the member of FIG. 13.

The inner member 223 shown in FIGS. 13 and 14 is put into and rigidly secured to the guide sleeve 217. Said inner member 223 comprises a head section 224, a flange 225 and a slide sleeve 226.

The head section 224 is press-fit into a sleeve section 215 which is formed by extending from the valve body 210 of the outer member 222 toward the upstream side of the liquid flow paths.

The flange 225 is press-fit into the guide sleeve 217.

The slide sleeve 226 is slidably inserted into the inside of guide sleeve 218 of the spin element 204 such that it may freely slide without encountering any significant resistance.

The head section 224 has a through bore 227 arranged at the center thereof and a radial groove 229 arranged at a top 228 thereof.

The sleeve section 215 of the outer member 222 has a radial window hole 230 corresponding to the radial groove 229 arranged in the head section 224 of the inner member 223.

On the other hand, a guide sleeve 231 extending from the valve seat 208 of the nozzle head 202 toward the upstream side of the liquid flow paths also has a radial window hole 232 corresponding to the radial window hole 230.

With the above described arrangement, the liquid flow path 233 of the discharge pipe F is held in communication with the annular groove 222B arranged in front of the pressure bearing surface 214 of the pressure bearing sleeve 211 of the outer member 222 via the port 234 of the spin element 204, the liquid flow path 209, the inner space 226A of the slide sleeve 226 of the inner member 223, the through bore 227, the groove 229 and the window holes 230 and 232.

In the above described second embodiment, the valve body 210 is pressed against the valve seat 208 by liquid pressure applied to the horizontal projection surface area of the inner member 223 facing the liquid flow path 209 and by the resilient force of the spring member 213. The outer member 222 is pressed toward the upstream side of the liquid flow paths under liquid pressure in the liquid flow path 209, which pressure is applied to the horizontal projection surface area of the pressure bearing surface 214 of the pressure bearing sleeve 211 of the outer member 222.

Figure 15:
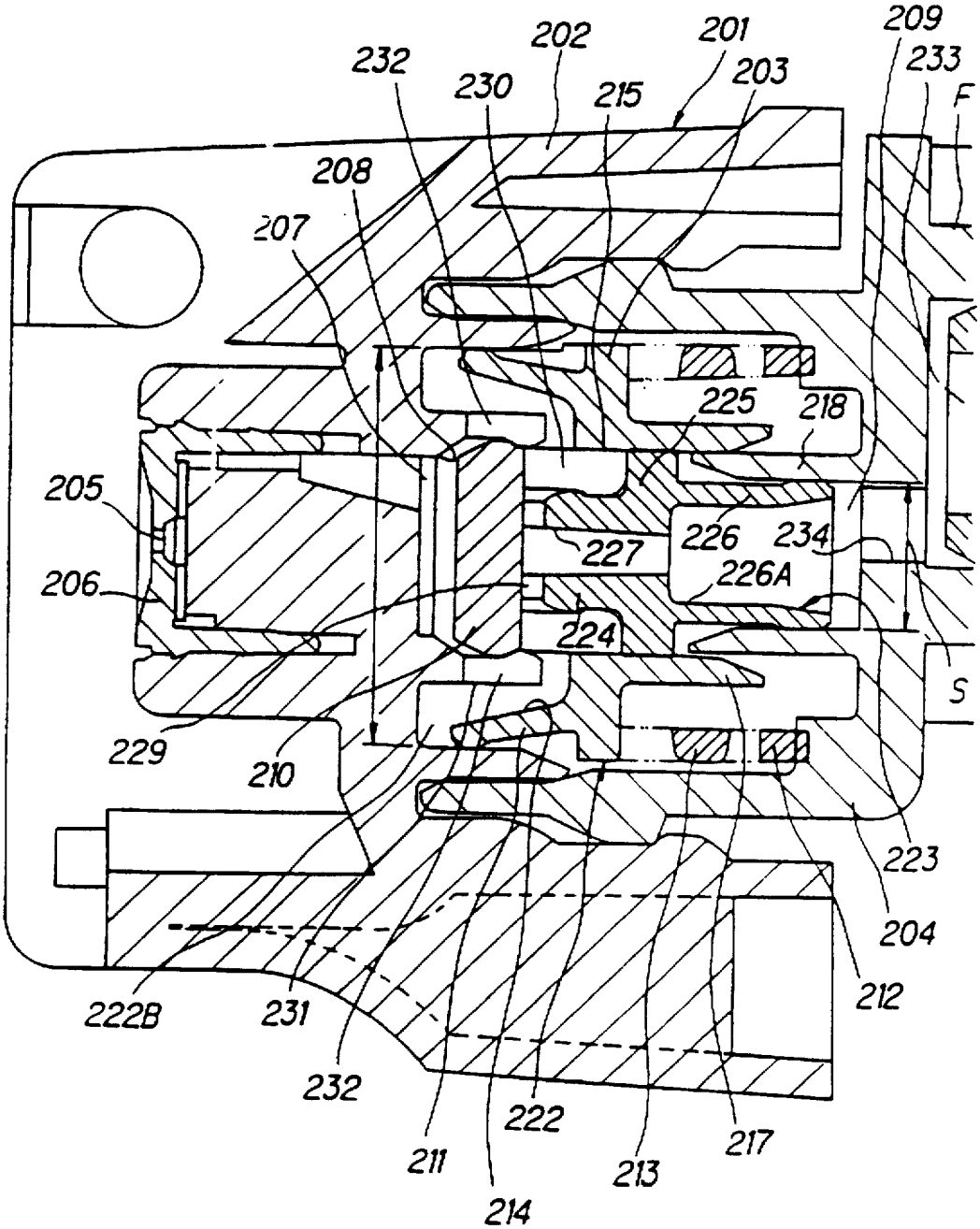
FIG. 15 is an enlarged longitudinal sectional view of the embodiment of FIG. 9, showing the inside when it is discharging liquid.

An appropriate value for the horizontal projection surface area of the pressure bearing surface 214 is selected such that the component of the force generated by the proper liquid discharge pressure applied to said horizontal projection surface area of the pressure bearing surface 214 is greater than the sum of the force generated by the proper liquid discharge pressure applied to the horizontal surface area of the inner member 223 facing the liquid flow path 209 and the resilient force of the spring member 213. When the liquid pressure reaches the level of the proper liquid discharge pressure, the valve body 210 is moved from the valve seat 208 and opened under liquid pressure to make the liquid flow path 209 communicate with the liquid flow path 207 arranged downstream relative to the valve seat 208 as shown in FIG. 15 so that liquid is discharged through the discharge aperture 205 of the nozzle tip 206.

When the liquid pressure falls under the proper liquid discharge pressure, the valve body 210 is closed to completely stop any discharge of liquid so that liquid can be effectively prevented from dripping out as in the case of the first embodiment.

In the second embodiment as described above, the inner member 223 is press-fit into the outer member 222 that is provided with a liquid guide 203 having a valve body 210, and the opening of the slide sleeve 226 of the inner member 223 faces vis-a-vis the liquid flow path 209. Thus, the horizontal projection surface area of the slide sleeve 226 as indicated by arrow S in FIGS. 9 and 15 can be made very small relative to the corresponding surface area of the first embodiment, so as to increase the ratio of said horizontal projection surface area of the slide sleeve 226 to the horizontal projection surface area of the pressure bearing surface 214 of the pressure bearing sleeve 211.

This means that the initial priming operation for eliminating air in the liquid cylinder and drawing up liquid through the cylinder by reciprocating the piston can be carried out in a short period of time.

Additionally, since the valve body 210 of the second embodiment can be opened simply by using pneumatic pressure in the initial priming operation, the discharge valve 111 as shown in FIG. 33 can be omitted.

FIGS. 16 through 19 show, in enlarged longitudinal cross section, the pump unit of a first embodiment of liquid discharge device according to the invention of the claim 2. The pump unit 22 comprises a cylinder 23 and a piston 24.

The cylinder 23 comprises an outer sleeve 25 designed to cooperate with a piston 24, and an inner sleeve 27 in which a spring 26 is arranged to urge the piston 24 to move back to the retracted position.

A cylinder chamber 28 is formed between the outer sleeve 25 and the inner sleeve 27 and held in communication with a liquid flow path 110 provided with a ball valve 120 (which operates as a check valve) by way of a liquid intake/discharge port 30 bored through a bottom wall 29 the cylinder chamber 28.

An inner peripheral wall 31 of the outer sleeve 25 is provided with a plurality of short and shallow grooves 32 running longitudinally near the bottom wall 29.

While the illustrated short and shallow grooves 32 are arranged on the inner peripheral wall 31, pairs of short and low ridges may alternatively be formed longitudinally such that the interval separating each pair of ridges functions as a short groove and shallow groove.

The outer sleeve 25 is additionally provided at a position near the bottom wall 29 with an air intake port 123 for drawing out air into the container to which the trigger type liquid discharge device is fitted. Also, at a position closer to the opening 129 of the outer sleeve 25 than the air intake port 123, the outer sleeve 25 is provided with a plurality of shallow outer air feeding grooves 33 running longitudinally.

Note that, in the illustrated embodiment, the shallow grooves 32 are short in the longitudinal direction but rather wide in the peripheral direction.

A stroke end side end portion of the piston 24 located close to the bottom wall 29 of the cylinder 23 has a rather thick wall portion, which is provided at the inner and outer peripheries with respective resilient annular skirts 35 and 36 extending toward the stroke end side to closely contact with the inner peripheral wall 31 of the outer sleeve 25 and the outer peripheral wall 34 of the inner sleeve 27 respectively.

The thick wall portion is additionally provided on the approach end side peripheral edge thereof with an annular skirt 37 extending toward the approach end side to closely contact with the inner peripheral wall 31 of the outer sleeve 25.

Figure 19:
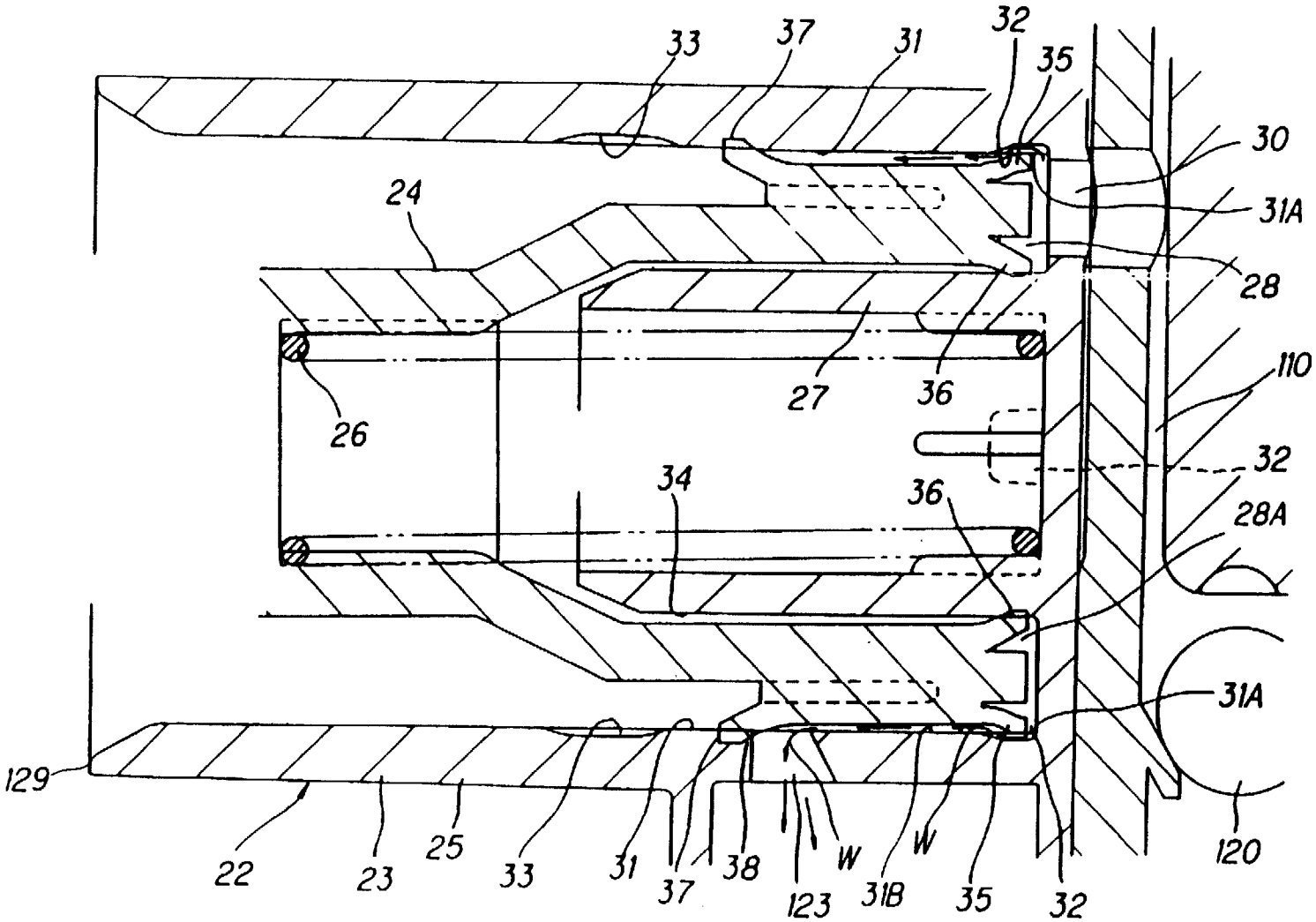
FIG. 19 is an enlarged longitudinal sectional view of the pump unit of FIG. 17, showing the inside when the discharging operation is finished and it is moved into a residual pressure relieving phase.

The interval separating the resilient annular skirts 35 and 37 is so selected that, as seen from FIG. 19, when the annular skirt 35 rides on the short and shallow grooves 32, the annular skirt 37 closely contact with the inner peripheral wall 31 of the outer sleeve 25 at an edge portion 38 of the air intake port 123 located close to the opening 129 of the outer sleeve 25.

Figure 16:
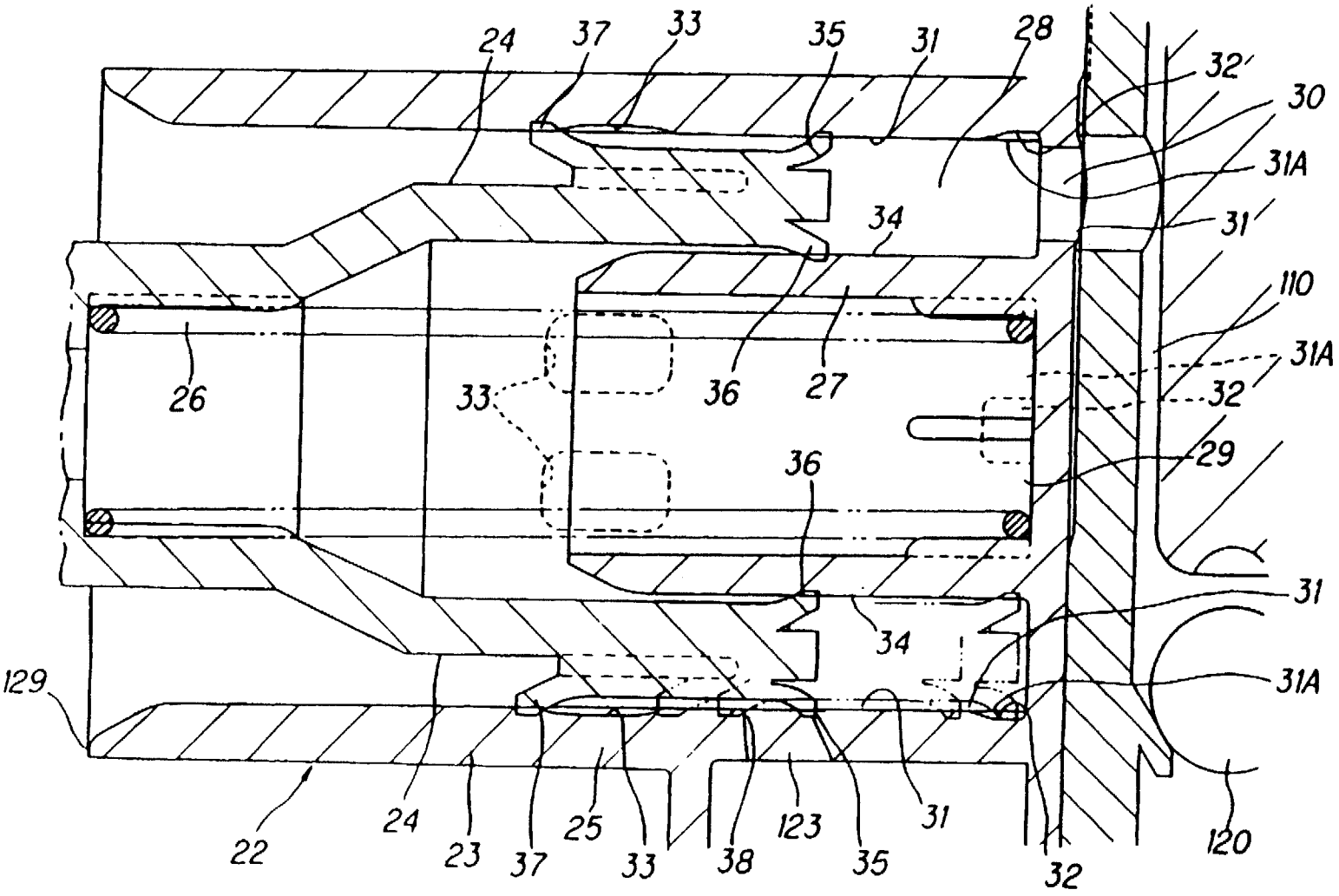
FIG. 16 is an enlarged longitudinal sectional view of the pump unit of a first embodiment of liquid discharge device according to the inventions of the claim 2 and the claim 4, showing the inside when it is in a standstill state.
Figure 17:
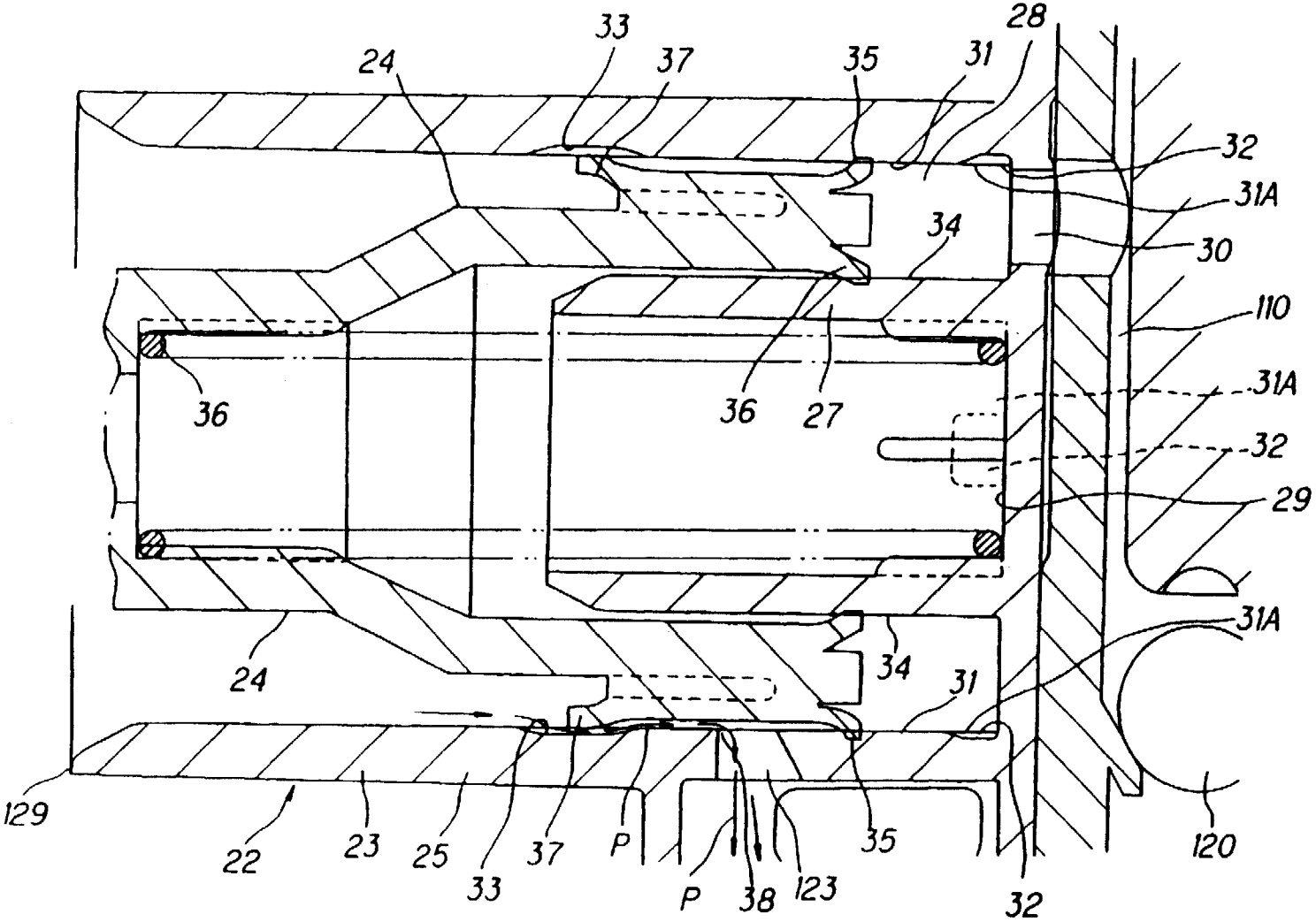
FIG. 17 is an enlarged longitudinal sectional view of the pump unit of FIG. 16, showing the inside during an air intake phase.
Figure 18:
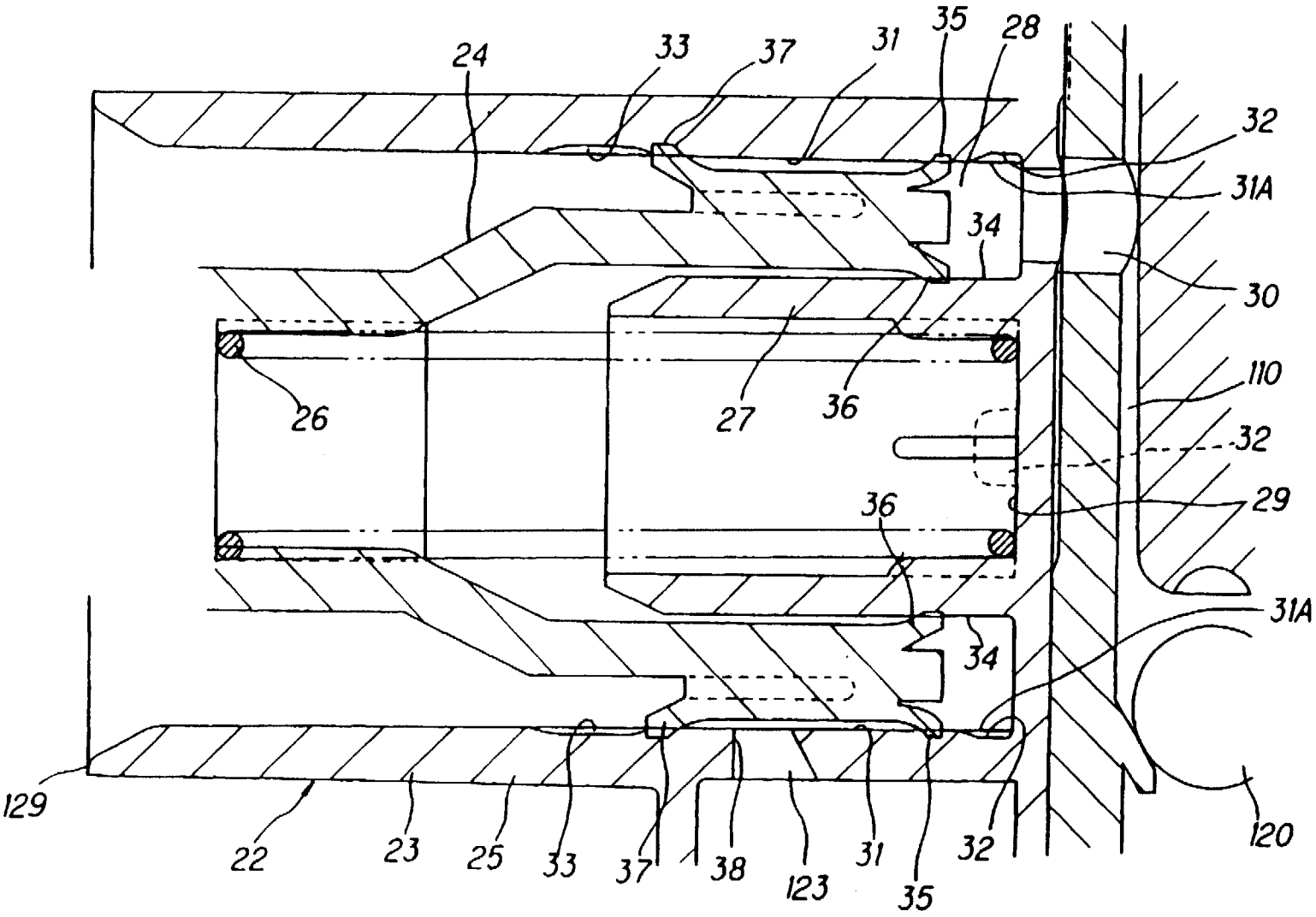
FIG. 18 is an enlarged longitudinal sectional view of the pump unit of FIG. 17, showing the inside during a liquid discharge phase, showing the state after that of FIG. 17.

An interval between the shallow outer air feeding grooves and the air intake port 123 is so selected that, as seen from FIG. 16, when the piston 24 takes the approach end position, the shallow outer air feeding grooves 33 and the air intake port 123 are closed by the annular skirts 35 and 37, whereas, when the piston 24 is in the compression stroke, the annular skirt 37 rides on the shallow outer air feeding grooves 33 as shown in FIG. 17 and outer air is fed into the container via the air intake port 123 as shown by arrow P in FIG. 17, while the communication between the shallow outer air feeding grooves 33 and the air intake port 123 is blocked by the annular skirt 37 before the end of the compression stroke.

When the annular skirt 35 rides on the short and shallow groove 32 at the end of the compression stroke, the annular skirt 35 closely contacts with the portions 31A of the inner peripheral wall 31 adjacent to the respective short and shallow grooves 32 but does not falls into the grooves 32. Thus, the liquid remaining in the remaining portion **28*a* of the cylinder chamber 28 and remaining in the liquid flow paths between the port 30 and the discharge aperture 118 (illustrated in FIG. 33) returns into the container under its own pressure by way of the short and shallow grooves 32, the gap 31B between the annular skirt 35 and the annular skirt 37 and the air intake port 123, so that any residual pressure would not affect the discharge aperture 118** and no liquid would drip out therethrough after the end of a discharging cycle.

Figure 20:
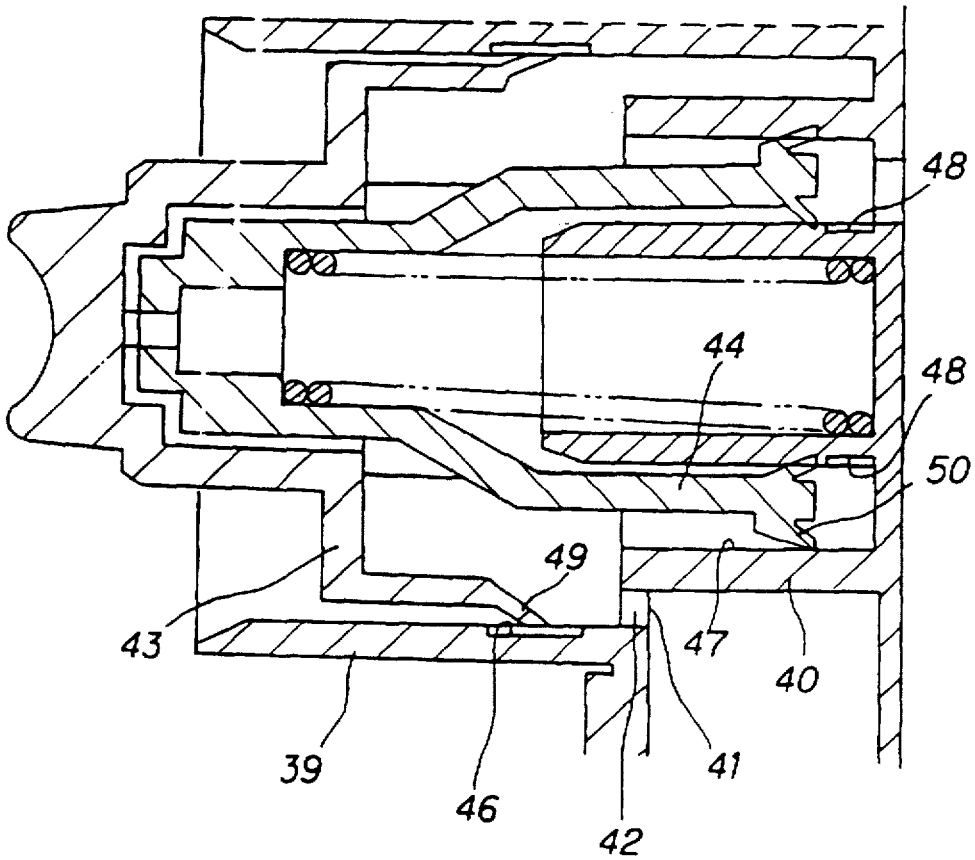
FIG. 20 is an enlarged longitudinal sectional view of the pump unit of a second embodiment of liquid discharge device according to the invention of the claim 6 showing the inside during an air intake phase.
Figure 21:
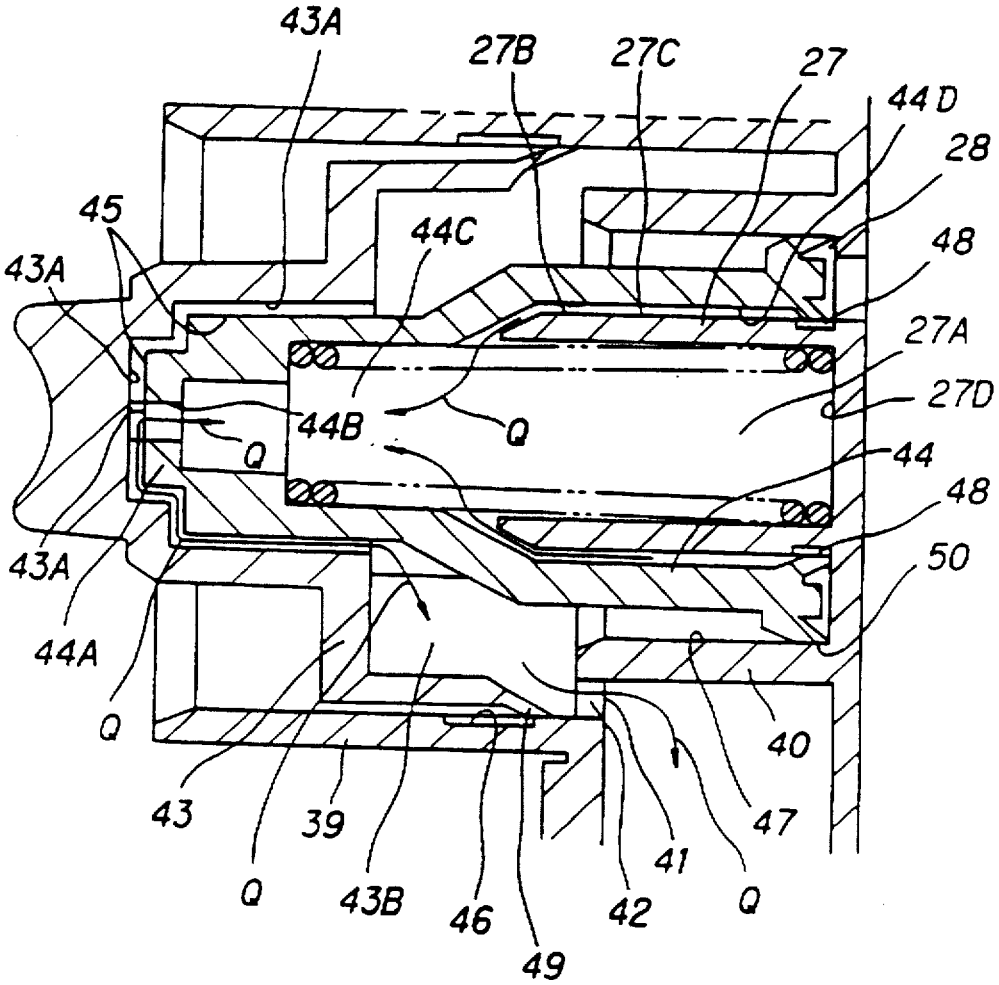
FIG. 21 is an enlarged longitudinal sectional view of the pump unit of FIG. 20, showing the inside during a residual pressure relieving phase.

FIGS. 20 and 21 show a second embodiment of trigger type liquid discharge device according to the claim 2, having a configuration similar to that of the first embodiment of FIGS. 16 through 19 except the following.

Namely, according to the first embodiment, the outer sleeve 25 of the cylinder 23 has a single inner diameter. On the other hand, according to the second embodiment, an outer sleeve of the cylinder comprises a large diameter outer sleeve section 39 located on the approach end side and a smaller diameter outer sleeve section 40 located on the stroke end side, said two outer sleeve sections being linked together by a connecting wall section 41 provided with an air intake port 42 that communicates with the inside of the container.

Additionally, according to the first embodiment, the piston 24 is realized as a one-piece component. On the other hand, according to the second embodiment, the piston comprises two components, in other words, an air piston 43 slidably movable in the larger diameter outer sleeve section 39 and a liquid piston 44 fitted in the air piston 43 and slidably movable in the smaller diameter outer sleeve section 40, said air piston 43 and said liquid piston 44 being connected with each other at a top engaging portion 45.

The air piston 43 is provided with grooves 43A on an inner peripheral surface thereof at the engaging portion 45.

In the illustrated embodiment, four grooves 43A are mutually displaced by an angle of 90° on the inner peripheral surface of the air piston 43.

The liquid piston 44 has a top 44A thereof which is provided with a small hole 44B.

The small hole 44B communicates with the grooves 43A so that consequently an inner space 44C of the liquid piston 44, the inner space 27A of the inner sleeve 27 of the cylinder, the gap 27C between the outer peripheral surface 27B of the inner sleeve 27 and the inner peripheral surface 44D of the liquid piston 44, an inner space 43B of the air piston 43 and the air intake port 42 are held in communication with one another.

The larger diameter outer sleeve section 39 is provided on the inner peripheral surface thereof with a shallow outer air feeding groove 46. The cylinder is provided at an outer peripheral surface 27B located adjacent to a bottom wall 27D thereof with a short and shallow groove 48 for removing residual pressure.

The interval between the annular skirt 49 of the air piston 43 and the annular skirt 50 of the liquid piston 44 is same as its counterpart of the first embodiment. Also, the functions of the outer air feeding groove 46, the short and shallow groove 48 and the annular skirts 49 and 50 are same as their counterparts of the first embodiment.

Thus, as illustrated in FIG. 21, once the liquid piston 44 gets to the stroke end, the residual pressure in the cylinder chamber 28 is drawn back into the container by way of the above listed spaces and gaps as indicated by arrow Q and then through the air intake port 42.

Figure 22:
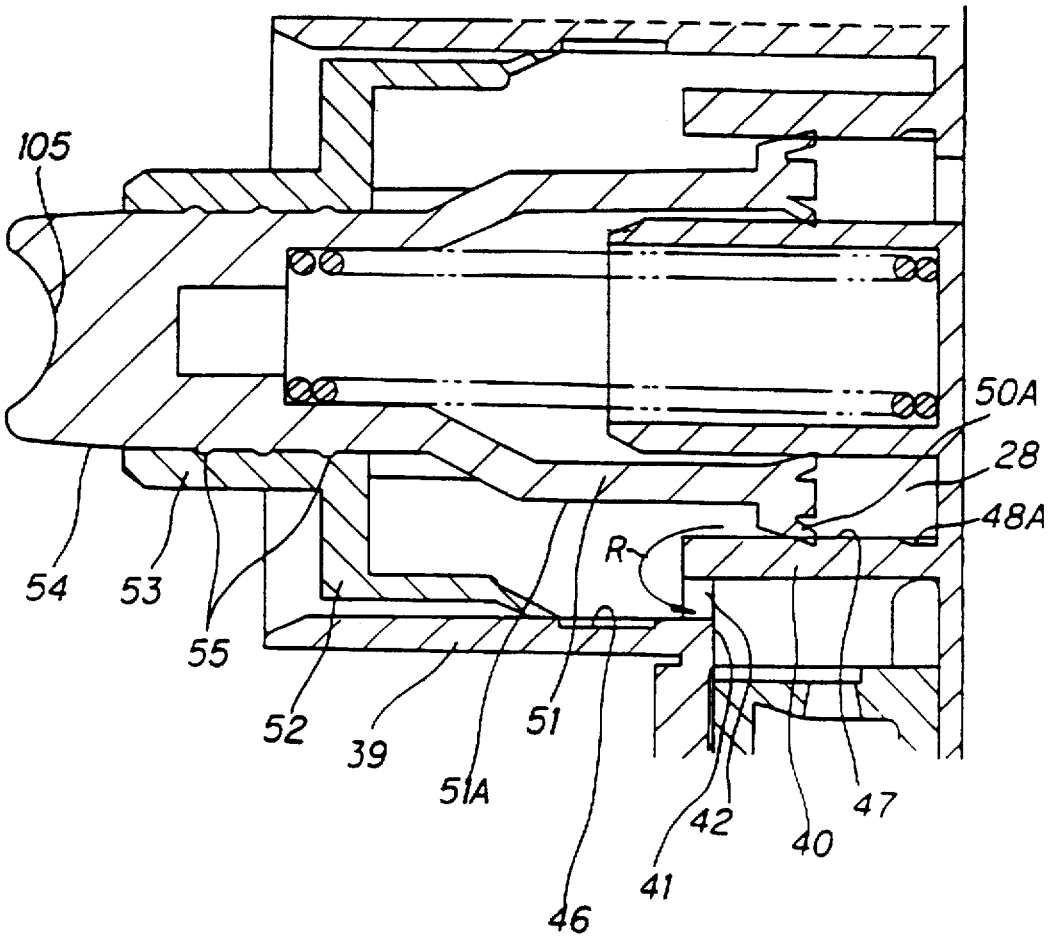
FIG. 22 is an enlarged longitudinal sectional view of the pump unit of a third embodiment of liquid discharge device according to the invention, showing the inside during a residual pressure relieving phase.

FIG. 22 shows a third embodiment of liquid discharge device according to the invention of the claim 2. According to the second embodiment illustrated in FIGS. 20 and 21, the air piston 43 and the liquid piston 44 are linked together at the top engaging portion 45. On the other hand, according to the third embodiment. A liquid piston 51 is formed at the top thereof with a transversal groove 105 for bearing the pushing member 103 of the trigger 102. The air piston 52 has a fitting sleeve 53 which is secured to a wall 54 of the liquid piston 51 by means of undercuts 55.

In this embodiment, the cylinder comprises a large diameter outer sleeve section 39, a small diameter outer sleeve section 40 and an air intake port 42 arranged at a connecting wall section 41 which links the the large diameter outer sleeve section 39 and the small diameter outer sleeve section 40, as in the case of the above described second embodiment.

The large diameter outer sleeve section 39 is provided on an inner peripheral surface thereof with a shallow outer air feeding groove 46.

This third embodiment differs from the above described second embodiment in that the small diameter outer sleeve section 40 is provided on the inner peripheral surface 47 thereof with a short and shallow groove 48A for removing residual pressure.

In this embodiment, once the annular skirt 50A of the liquid piston 51 rides on the short and shallow grove 48A, the residual pressure in the cylinder chamber 28 is drawn back into the container by way of the gap between the inner peripheral surface 47 of the small diameter outer sleeve section 40 and the outer peripheral surface 51A of the liquid piston 51 as indicated by arrow R and then through the air intake port 42.

Figure 23:
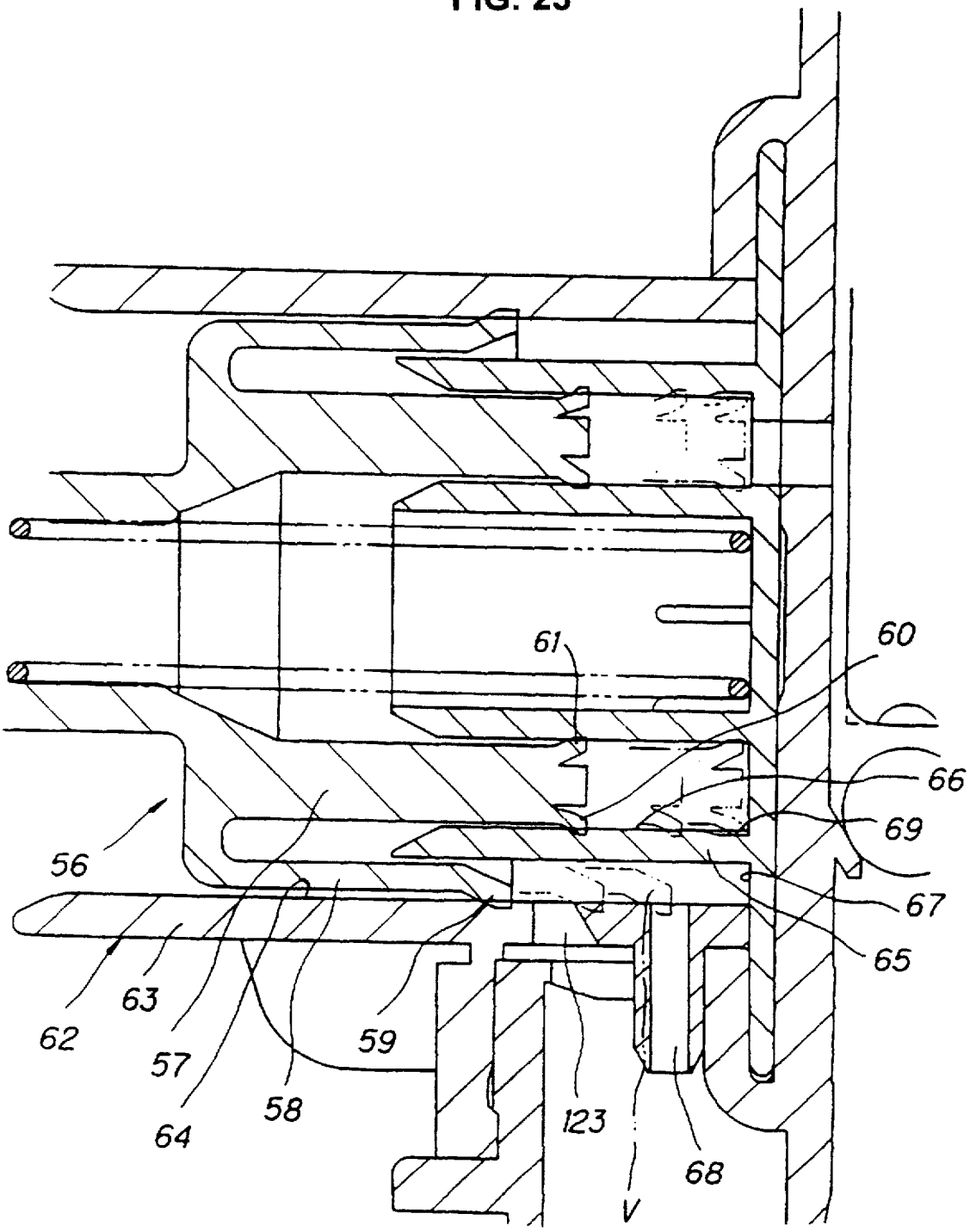
FIG. 23 is an enlarged longitudinal sectional view of the pump unit of a fourth embodiment of liquid discharge device according to the invention, showing the inside during a liquid discharge phase.

FIG. 23 shows a fourth embodiment of liquid discharge device according to the invention of the claim 2. The liquid discharge device comprises a piston section 56 having an inwardly disposed liquid piston 57 and an outwardly disposed air piston 58 integrally formed with the inwardly disposed liquid piston 57. Said liquid piston 57 and said air piston 58 are provided with annular skirts 59, 60 and 61 directed toward the stroke end side. The air piston 58 is held in close contact with an inner wall surface 64 of a large diameter outer sleeve section 63 of the cylinder 62. The liquid piston 57 is held in close contact with an inner wall surface 66 of a small diameter inner sleeve section 65 of the cylinder 62.

In this embodiment, the large diameter outer sleeve section 63 is not provided with a shallow groove for introducing outer air on the inner wall surface 64 thereof. Instead, so that outer air is directly introduced into the container.

Note that a short pipe 68 is suspended downward from the air intake port 123 at a position close to the cylinder bottom wall 67.

The short pipe 68 is so designed that residual liquid expelled from a short and shallow groove 69 arranged on an inner wall surface 66 of the small diameter inner sleeve section 65 for removing residual pressure falls vertically into the container through gaps between the inner and outer peripheral surfaces of the small diameter inner sleeve section 65, the outer peripheral surface of the liquid piston 57 and the inner peripheral surface of the air piston 58.

With this arrangement, once the annular skirt 60 rides on the short and shallow groove 69, the annular skirt 59 closes the air intake port 123 as it is moved to the position indicated by V in FIG. 23.

Figure 24:
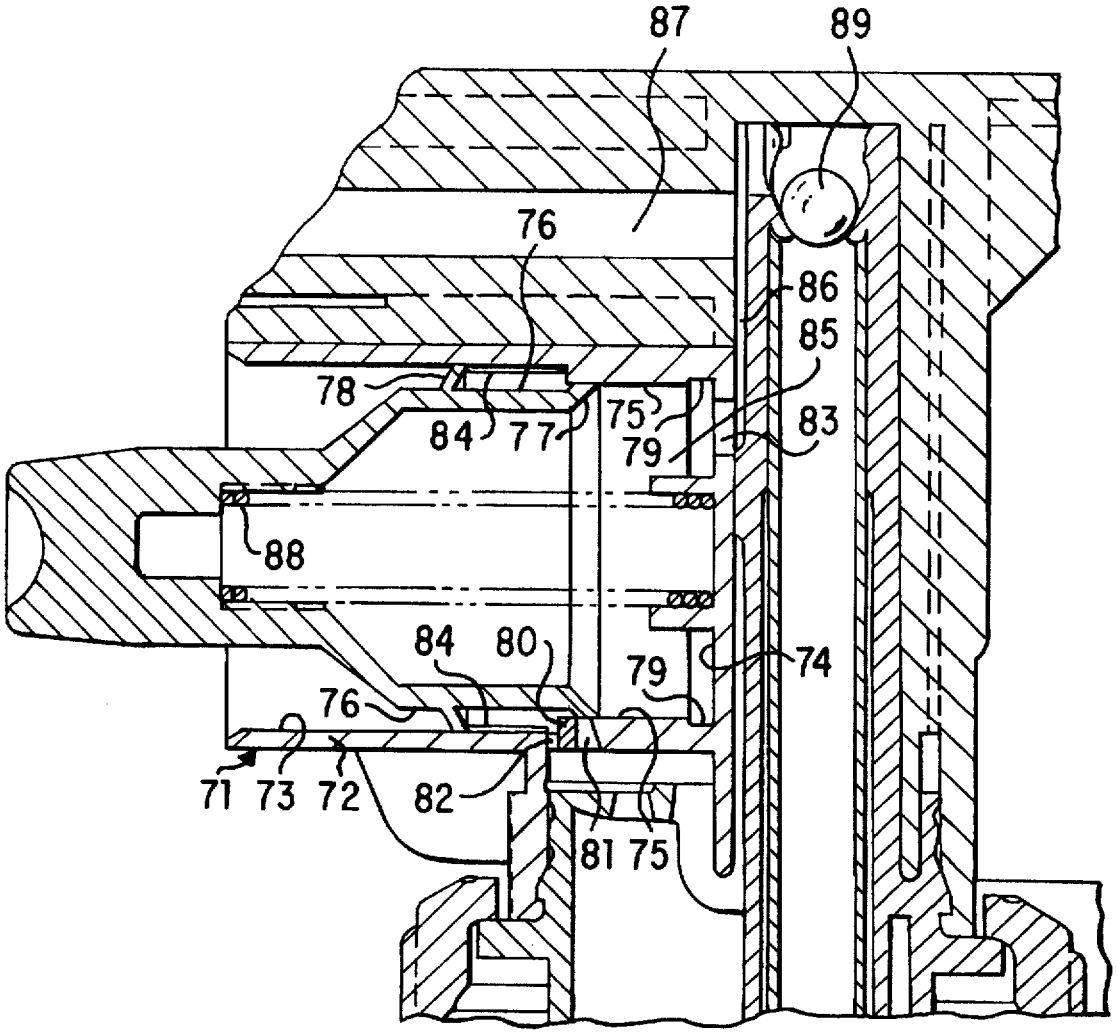
FIG. 24 is an enlarged longitudinal sectional view of a fifth embodiment of pump mechanism according to the invention of the claim 6, showing when the piston gets to the approach end.
Figure 25:
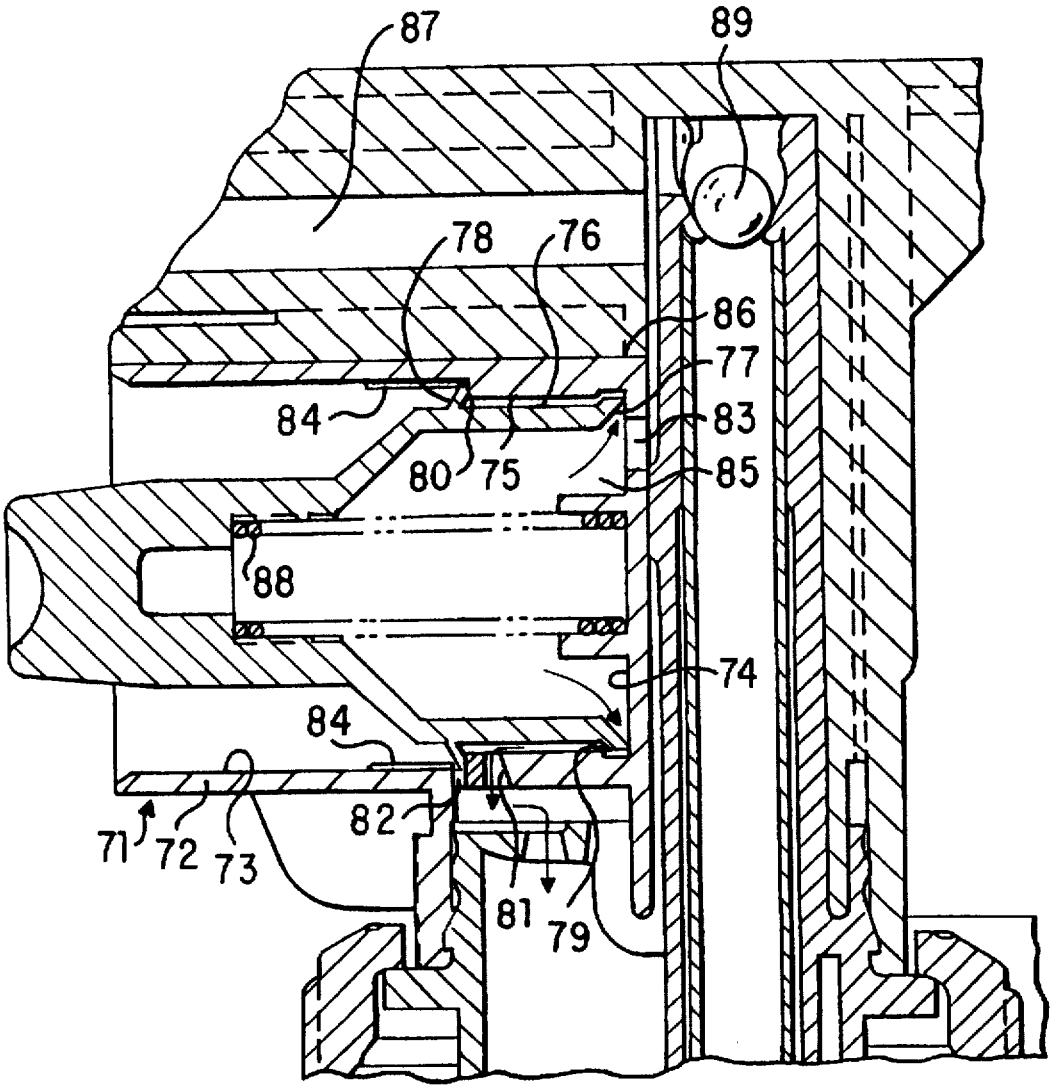
FIG. 25 is an enlarged longitudinal sectional view similar to FIG. 24 but showing the residual pressure clearing stroke.

FIGS. 24 and 25 show an embodiment of the claim 6 in addition to a fifth embodiment of the invention of claim 2, wherein an inner peripheral wall of a cylinder 72 of a pump unit 71 is divided into a large diameter section 73 located on the open end side and a small diameter section 75 located on the side of the bottom wall 74. An annular skirt 77 is formed on the stroke end side of a piston 76 to resiliently abut the small diameter section 75 of the cylinder 72. An another annular skirt 78 is formed on the approach end side of the piston 76 to resiliently abut the large diameter section 78 of the cylinder 72.

A short and shallow groove 79 is peripherally arranged on the cylinder 72 at a position where the small diameter section 75 of the cylinder 72 is connected to the bottom wall 74. As seen from FIG. 25, the entire length of the small diameter section 75 is so selected that, when the piston 76 gets to the stroke end and an edge of the annular skirt 77 gets into the short and shallow groove 79, the edge of the other annular skirt 78 is located on a boundary 80 of the large diameter section 78 and the small diameter section 75.

A liquid flow path 81 is formed in the small diameter section 75 at a position close to said boundary 80 and communicates with the inside of the container. An air intake port 82 is formed in the large diameter section 78 at a position close to said boundary 80.

In FIGS. 24 and 25, reference numeral 88 denotes a liquid intake/discharge port.

A plurality of low projecting ridges 84 are formed longitudinally on the inner peripheral wall of the large diameter section 78 of the cylinder 72 in a position slightly closer to the bottom wall 74 than the peripheral position occupied by the annular skirt 78 when the piston 76 gets to the approach end as shown in FIG. 24.

In this embodiment, when the piston 76 is moved from the approach end position shown in FIG. 24 to the stroke end position shown in FIG. 25, the liquid contained in a cylinder chamber 85 is compressed and flows through a port 83 into a liquid flow path 86 to a liquid flow path 87, because the annular skirt 77 moves along the inner peripheral wall of the small diameter section 75.

When the peripheral edge of the annular skirt 77 gets into a short and shallow groove 79 at the stroke end, any residual pressure that may exist within the piston **76*b* and in the liquid flow path 86 etc. is discharged to the container through the liquid flow path 81 and the gap between the short and shallow groove 79 and the annular skirt 77** to remove and possible cause of dripping of liquid.

Since the annular skirt 78 is located on the boundary 80 to open the air intake port 82 under this condition, air flows into the container from the atmosphere to prevent any negative pressure from taking place within the container.

As the piston 76 is moved back by the resiliency of a spring 88, negative pressure is generated in the cylinder chamber 85 so that a check valve 89 is opened by the liquid, which is then sucked into the chamber 85 through liquid flow path 86 and the port 83.

As the piston 76 moves back, the annular skirt 78 runs onto the low projecting grooves 84 to make the air intake port 82 communicate with the atmosphere so as to prevent any negative pressure from taking place within the container. When the piston 76 gets to the approach end, the annular skirt 78 closely contacts with the inner peripheral wall of the large diameter section 73 to prevent the liquid from leaking out through the air intake port 82.

It may be needless to say that said short and shallow groove 79 may be replaced by a low projecting groove running longitudinally, and the low projecting ridges 84 may be replaced by short and shallow grooves running longitudinally.

Figure 31:
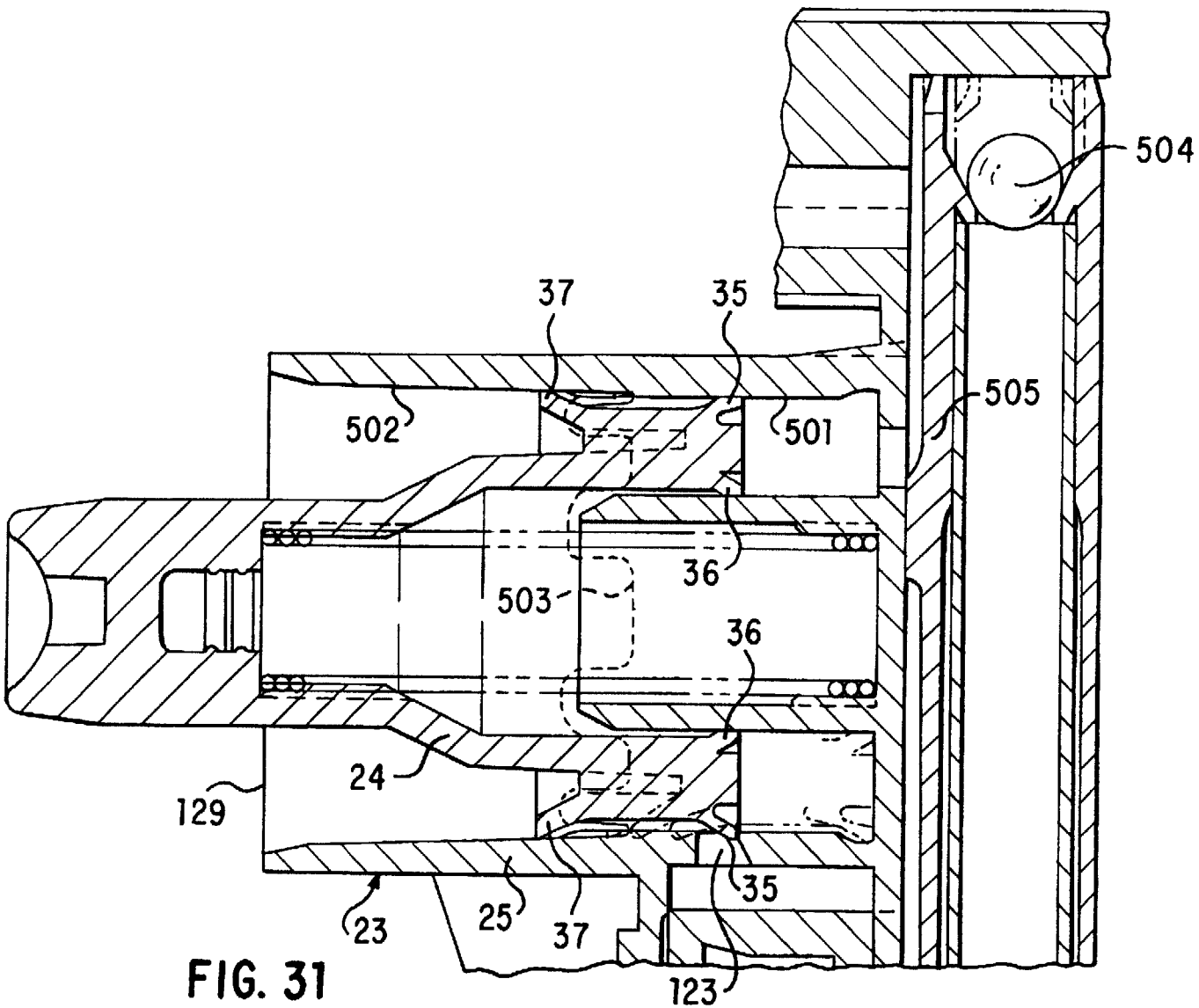
FIG. 31 is an enlarged longitudinal section view of an another embodiment according to the invention of the claim 4.

The low projecting ridges 84 may be replaced by shallow outer air feeding grooves 33 illustrated in FIG. 16 or by a boundary 503 illustrated in FIG. 31.

Figure 26:
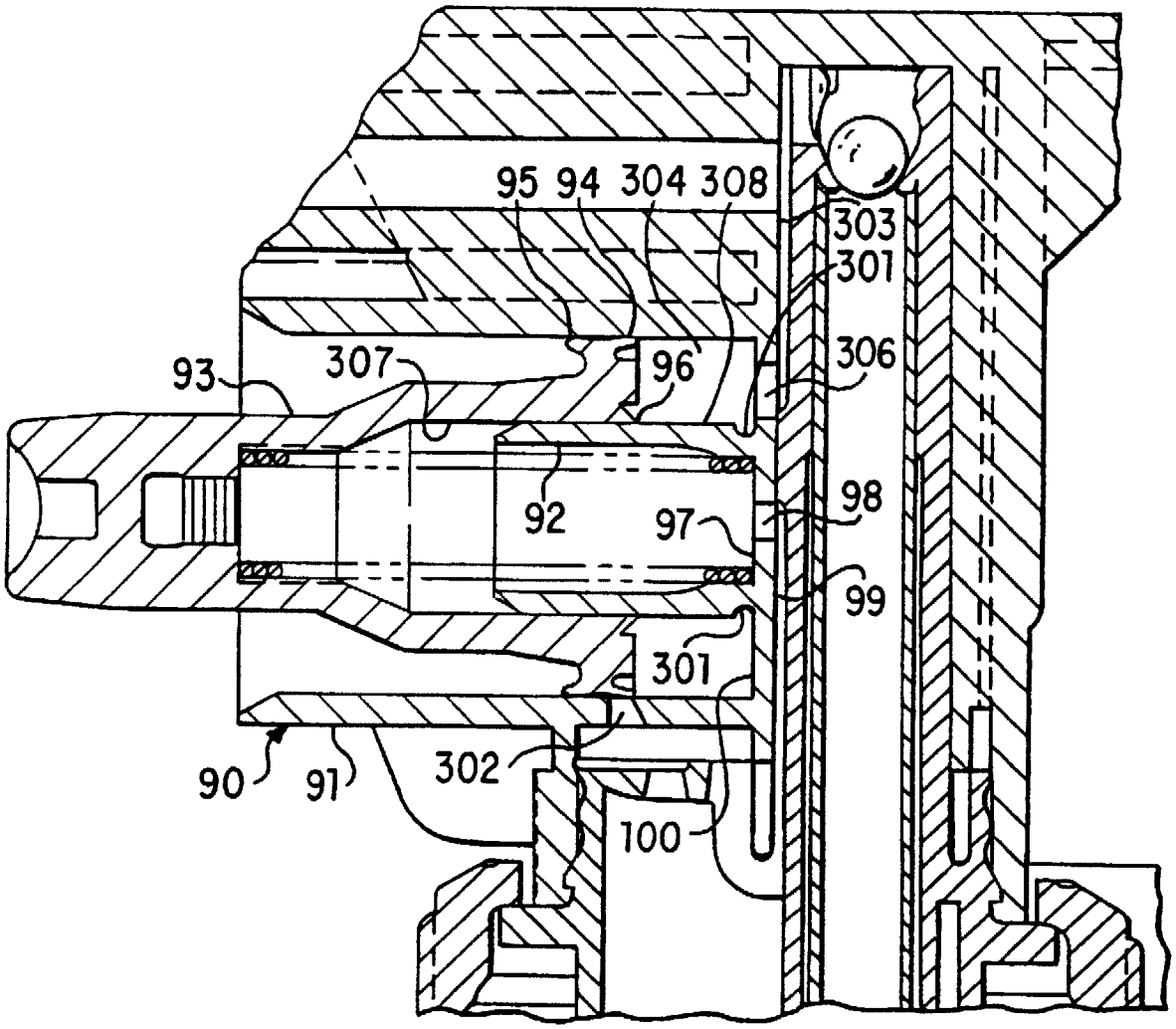
FIG. 26 is an enlarged longitudinal sectional view of the pump mechanism according to the invention of the claim 7, showing when the piston gets to the approach end.
Figure 27:
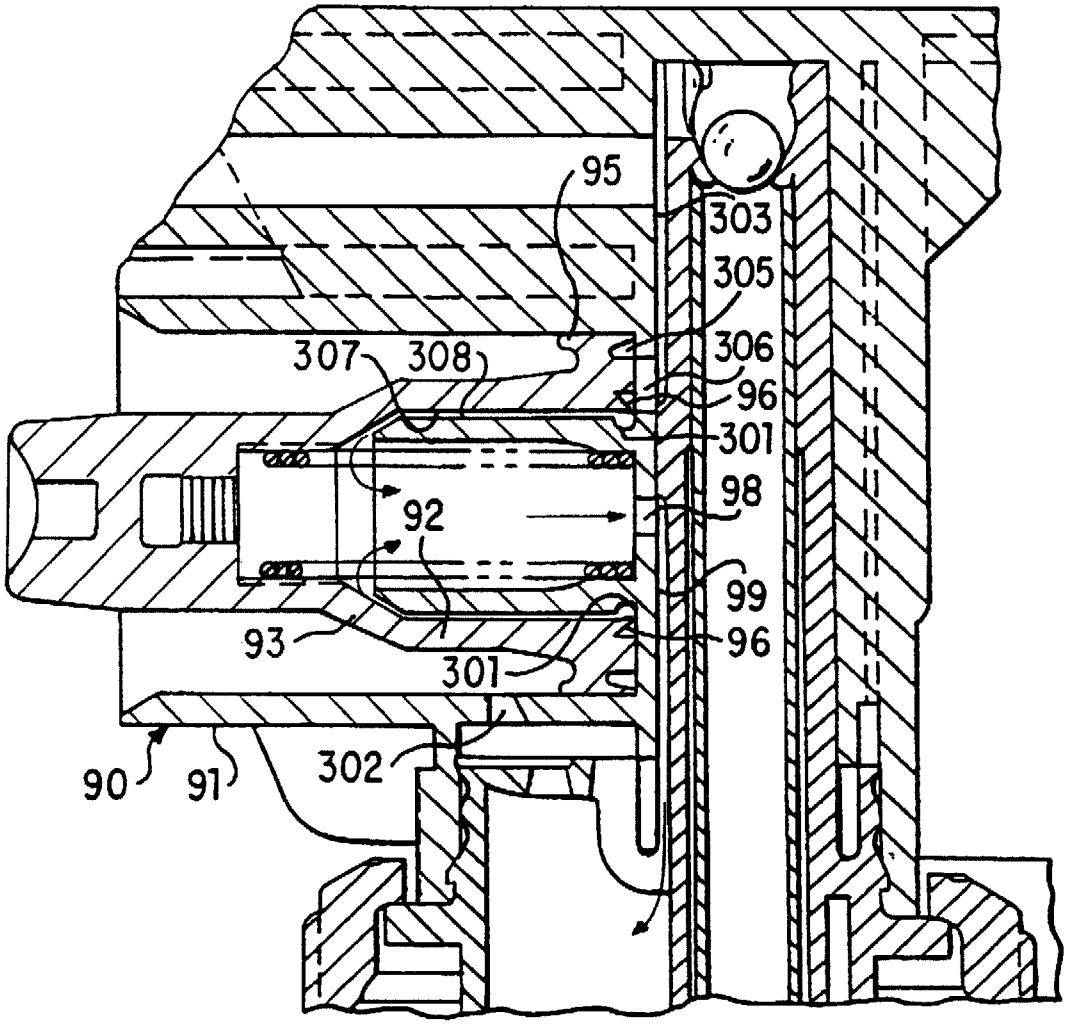
FIG. 27 is an enlarged longitudinal sectional view similar to FIG. 26 but showing the residual pressure clearing stroke.

FIGS. 26 and 27 show an embodiment of the invention of claim 7. A cylinder 91 of a pump unit 90 has an inner sleeve 92. A piston 93 has annular skirts 94 and 95 that resiliently abut an inner peripheral wall of the cylinder 92 and an another annular skirt 96 resiliently abuts an outer peripheral wall of the inner sleeve 92. A hole 98 is bored in a bottom wall 97 of the inner sleeve 92 and communicates with an upper end of a liquid flow path 99 formed in the bottom wall 97 and communicating by turn with the inside of the container.

A short and shallow groove 301 is peripherally provided on the outer peripheral surface of the inner sleeve 92 along a connecting section of said outer peripheral surface of the inner sleeve 92 and the bottom wall 100 of the cylinder 91 in such a way that, when the piston 93 gets to the stroke end as shown in FIG. 27, the edge of the annular skirt 96 gets into the short and shallow groove 301 and a gap is formed between said edge and a bottom of the short and shallow groove 301.

In order to allow air to enter the container from the atmosphere, an air intake port 302 is formed on the cylinder wall in a position close to the open end of the cylinder than the position of the annular skirt 95 when the piston 93 gets to the stroke end.

In this embodiment, when the piston 93 gets to the stroke end as shown in FIG. 27, the edge of the annular skirt 96 gets into the short and shallow groove 301 and a gap is formed between the edge and the bottom of the groove so that any residual pressure that may exist in a liquid flow path 303, a remaining portion 305 of a cylinder chamber 304 and a port 306 may escape from the internal space of the piston 93 into the container through said gap, a gap between an inner peripheral surface 307 of the piston 93 and an outer peripheral surface 308 of the inner sleeve 92, the internal space of the inner sleeve 92, the hole 98 of the bottom wall 97 and the liquid flow path 99 as indicated by an arrow. Thus, any dripping of liquid due to the residual pressure may be effectively prevented from taking place.

In this embodiment, since any residual pressure that may exist around the pump unit 90 is removed by way of the short and shallow groove 301 of the inner sleeve 92 of the cylinder 91 and the hole 98 of the bottom walls 97, 100 and the liquid flow path 99, a greater extent of freedom is allowed in designing an outer air introducing structure in a form other than an air intake port 302 in order to prevent negative pressure from taking place within the container.

It may be needless to say that said short and shallow groove 301 can be replaced by a low projecting ridge running longitudinally.

Figure 28:
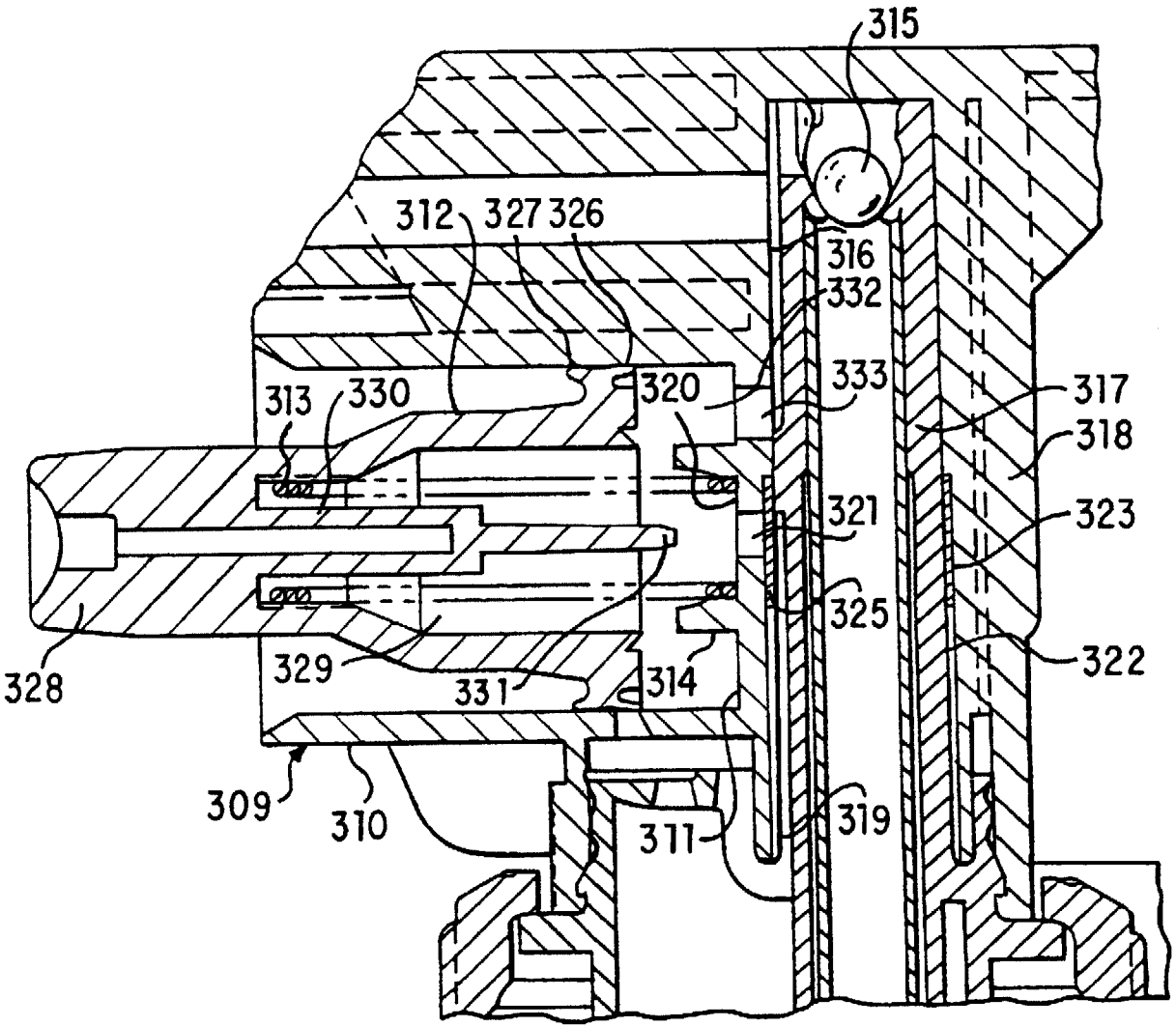
FIG. 28 is an enlarged longitudinal sectional view of an embodiment according to the invention of claim 8 and showing when the piston gets to the approach end.
Figure 29:
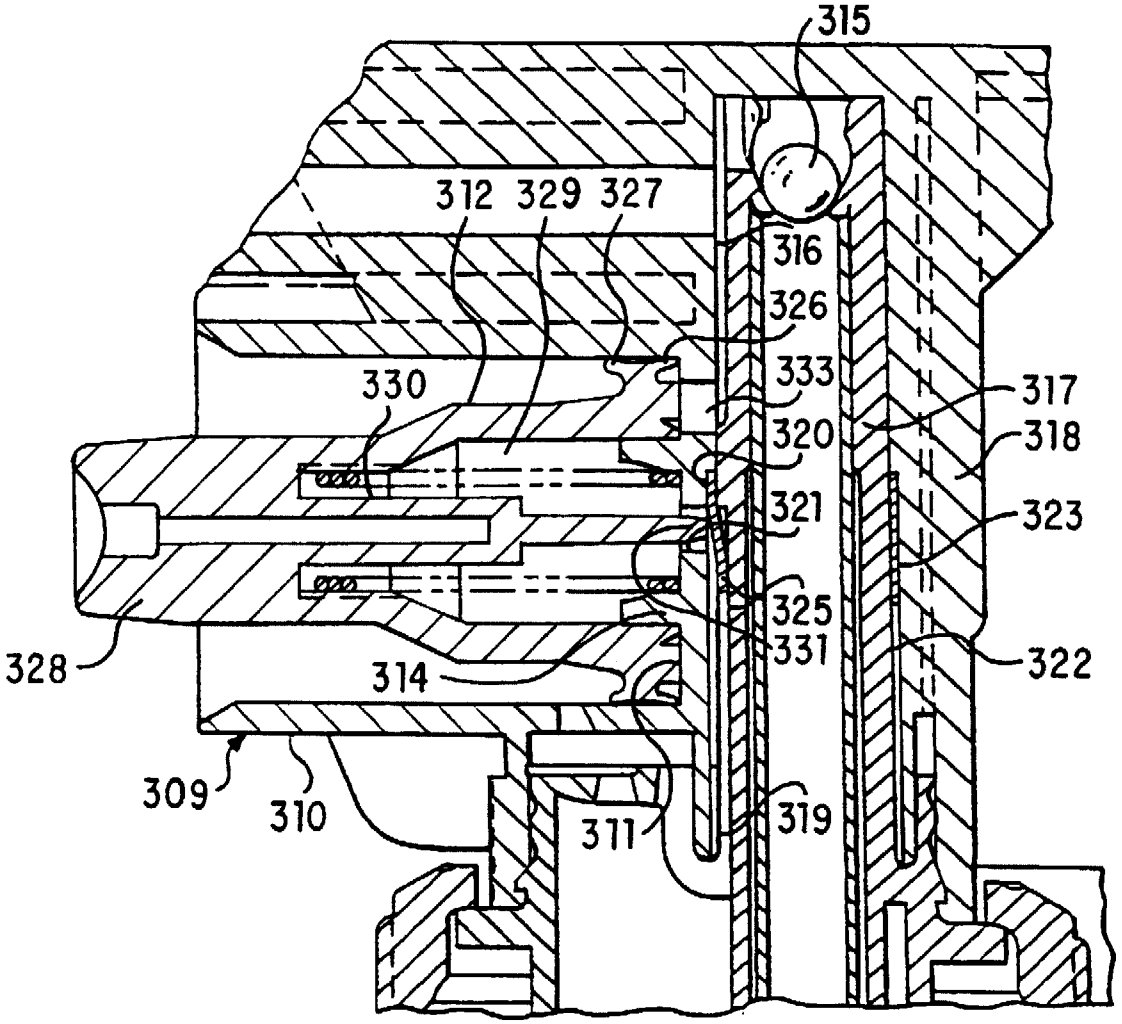
FIG. 29 is an enlarged longitudinal sectional view of the embodiment of FIG. 28 showing the residual pressure clearing stroke.

FIGS. 28 and 29 illustrate an embodiment of the invention of claim 8. A cylinder 310 of a pump unit 310 is provided in a bottom wall 311 thereof with an coaxial sleeve 314 for receiving a spring 313 for urging back a piston 312. At a position on an outer surface of the bottom wall 311 and facing a liquid guide pipe 317 having a check valve 315 and a liquid flow path 316, the cylinder 310 is provided with a liquid flow path 319 communicating with the inside of the container. Said spring receiving sleeve 314 is provided at an axial center of its bottom wall 320 with a hole 321 communicating said liquid flow path 319.

The liquid guide pipe 317 is provided in its outer peripheral wall facing said hole 321 with an annular groove 322. The annular groove 322 is provided with an annular resilient valve 323. An upper edge of said resilient valve 323 is sandwiched by the liquid guide pipe 317, an outer surface of the bottom wall 311 and the a grasping sleeve 318. A suspending sleeve section 325 of the resilient valve 323 closes said hole 321 from the outside.

The piston 312 has annular skirts 326 and 327 which resiliently abut the inner peripheral surface of the cylinder 310. The piston 312 has a pin body 330 arranged at the axial center thereof and projecting from an inner surface of a piston head 328 at the approach end side toward the stroke end side. When the piston 312 gets to the stroke end, a front end 331 of the pin body 330 passes through the hole 321. The resilient valve 323 closing said hole 321 from outside resiliently deforms as shown in FIG. 29 so as to release the closed condition of the hole 321.

As the closed condition of the hole 321 is released by the front end 331 of the pin body 330, any residual pressure that may exist in the liquid flow path 316, the cylinder chamber 332 and the port 333 may escape into the container when the piston 312 gets to the stroke end to terminate the liquid discharge cycle, so that any dripping of liquid due to the residual pressure may be effectively prevented from taking place.

According to the invention of claim 3, since the residual pressure is removed by positively causing the front end 331 of the pin body 330 to deform the resilient valve 323, any possible leakage of pressure and insufficient removal of residual pressure due to an accumulated effect of dimensional errors of the related components can be completely avoided to make the operation of dimensional control during the process of manufacturing the components very easy.

Figure 30:
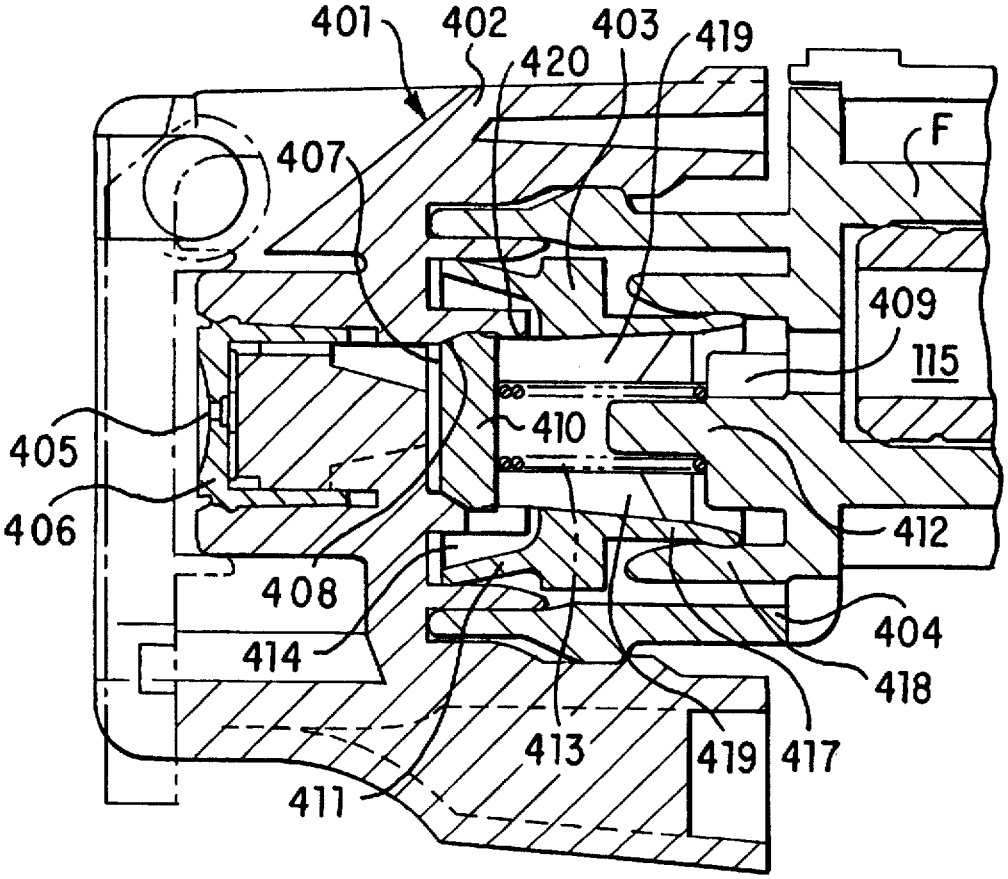
FIG. 30 is an enlarged longitudinal section view according to the invention of the claim 5.

FIG. 30 is an enlarged longitudinal section view of a nozzle head section 401 according the invention of the claim 5. The nozzle head section 401 comprises a nozzle head 402, a liquid guide 403, a spin element 404 and a nozzle tip 406 having a discharge aperture 405.

Said nozzle head 402 is provided with a valve seat 408 arranged in a liquid flow path 407 at a position upstream, as like the first and second embodiments. The liquid flow path 407 communicates with a liquid flow path 115 of the discharge pipe unit F through a liquid flow path 409, as like the first and second embodiments.

Said liquid guide 403 has a valve body 410 and a pressure receiving sleeve 411 integrally formed with the valve body 410. The valve body 410 abuts on the valve seat 408 to close the liquid flow path 407. The pressure receiving sleeve 411 has a pressure bearing surface 414 which is arranged to face the upstream side of the liquid flow path 407 for bearing the liquid pressure.

Said liquid guide 403 has a guide sleeve 417 which is inserted into an inside of a guide sleeve 418 of the spin element 404. A coil spring 418 is provided in the compressed state between a spring seat 412 provided on the the guide sleeve 418 and a rear side of the valve body 410. The coil spring 413 presses the valve body 410 to the valve seat 408.

In FIG. 30, the reference numeral 419 denotes a longitudinal projection for supporting the coil spring, which projection is provided in the inside of the guide sleeve 417 of the liquid guide 408.

By operating the trigger, the liquid pressed to the flow path 115 flows through the liquid flow path 409 into the inside of the guide sleeve 417 of the liquid guide 403, and then flows between the longitudinal projections 419 and through an opening 420. Thus, the liquid pressure presses a pressure bearing surface 414 of the pressure receiving sleeve 411.

When the force generated by the liquid pressure which is applied to the pressure bearing surface 414 is greater the force generated by both the resilient force of the spring member 413 and the force of the liquid pressure which is applied to the rear surface of the valve body 410, the valve 410 opens. In this embodiment, since the coil spring 413 is not integrally formed, it is very easy to form the liquid guide 403.

FIG. 31 illustrates an embodiment of the invention of the claim 4. In the first embodiment illustrated in FIG. 16, a plurality of shallow outer air feeding groove 33 are depressedly and longitudinally formed on the inner surface of the outer sleeve 25 of the cylinder 23. On the other hand, in this embodiment illustrated in FIG. 31, the outer cylinder 25 has the inner surface which comprises an inner surface 502 at the opening 129 side and an inner surface 501 provided at an area where the resilient annular skirts 35, 36, 37 moves upon a liquid discharge phase. The inner surface 502 has a diameter slightly larger than a diameter of the inner surface S01. A boundary 503 of the diameter between the inner surface 502 and the inner surface 501 has a wave shape as illustrated by a dotted line in FIG. 31. When the annular skirt 37 reaches to the wave-shaped boundary 503, outer air is introduced through the opening 129 to the air intake port 123.

This embodiment has a construction same as that of the embodiment illustrated in FIG. 16 except the constructions of the above described wave-shaped boundary 503 and a liquid flow sleeve 505 having a check valve 504.

According to this embodiment of the claim 4, it is easy to remove the cylinder 23 from a metal mold.

Of the above described embodiments according to the the invention of the claim 2, the second and third ones have pistons that are configured to allow easier retrieval from the mold to improve their productivity if compared with the first embodiment, because the piston is constituted of an air piston and a liquid piston in the case of the second and third embodiments and additionally the annular skirts of the piston are directed in a same direction in the case of the third embodiment.

FIG. 32 shows, in enlarged cross section, a principal area of a trigger type liquid discharge device according to the the invention of the claim 3. As shown, the trigger type liquid discharge device has a single nozzle head section 70 comprising a nozzle head 2, a liquid guide 3, a spin element 4 and a nozzle tip 6 same as those of a liquid discharge device according to the invention of the claim 1 and illustrated in FIGS. 1 through 8, while it also has a pump unit 71 comprising cylinder members 39, 40, 41 and 42 and piston members 43, 44, 46, 48, 49 and 50 same as those of a liquid discharge device according to the invention of the claim 2 and illustrated in FIGS. 20 and 21. With this arrangement, again, undesired liquid and bubbles can be effectively prevented from dripping out of the discharge aperture 5.

What is claimed is:

1. A trigger type liquid discharge device comprising a container, a pump unit having a cylinder and a piston, a discharge pipe (F) having a discharge aperture (5), and a trigger (102) for reciprocating the piston, wherein liquid drawn up from the container is discharged through the discharge aperture by movement of the piston to a stroke end, characterized in that a liquid guide (3) is arranged in a liquid flow path (7) disposed upstream relative to the discharge aperture (5), said liquid guide (3) comprising a valve body (10) for closing the liquid flow path (7), a pressure bearing sleeve (11) formed integrally with the valve body (10), an anchor member (12) to be secured to the discharge pipe, and a spring member (13) for coupling said integrally formed valve body (10) and the pressure bearing sleeve (11) with the anchoring member (12), said pressure bearing sleeve (11) has a pressure bearing surface (14) facing the upstream side of the liquid flow path (7) for bearing the liquid pressure, an area of said pressure bearing surface (14) is so selected that a force generated by a proper liquid discharge pressure that is applied to said pressure bearing surface (14) is greater than a sum of a resilient force of the spring member (13) and a force applied to the valve body (10) and directed to the downstream side of the liquid flow path (7).

2. A trigger type liquid discharge device comprising a container, a pump unit having a cylinder and a piston, a discharge pipe (F) having a discharge aperture (5), and a trigger (102) for reciprocating the piston, wherein liquid drawn up from the container is discharged through the discharge aperture by movement of the piston to a stroke end, characterized in that an inner peripheral wall (31) of the cylinder (23) is provided with a plurality of short and shallow grooves (32) at a portion adjacent to a bottom wall (29) of the cylinder (23), said short and shallow grooves (32) running longitudinally, the inner peripheral wall (31) of the cylinder (23) is provided with an air intake port (123) communicating with an inside of the container, the piston (24) is formed with a pair of annular skirts (35, 37) held in close contact with the inner peripheral wall of the cylinder (23), and a gap separating said pair of annular skirts is so selected that, when one of the annular skirts (35) rides on the short and shallow grooves (32) of the cylinder, the other of the annular skirts (37) is brought into close contact with inner peripheral wall of the cylinder at a position close to an open edge of the cylinder than the air intake port (128).

3. A trigger type liquid discharge device comprising a container, a pump unit having a cylinder and a piston, a discharge pipe (F) having a discharge aperture (5), and a trigger (102) for reciprocating the piston, wherein liquid drawn up from the container is discharged through the discharge aperture by movement of the piston to a stroke end, characterized in that a liquid guide (3) is arranged in a liquid flow path (7) disposed upstream relative to the discharge aperture (5), said liquid guide (3) comprising a valve body (10) for closing the liquid flow path (7), a pressure bearing sleeve (11) formed integrally with the valve body (10), an anchor member (12) to be secured to the discharge pipe (F), and a spring member (13) for coupling said integrally formed valve body (10) and the pressure bearing sleeve (11) with the anchoring member (12), said pressure bearing sleeve (11) has a pressure bearing surface (14) facing the upstream side of the liquid flow path (7) for bearing the liquid pressure, an area of said pressure bearing surface (14) is so selected that a force generated by a proper liquid discharge pressure that is applied to said pressure bearing surface (14) is greater than sum of a resilient force of the spring member (13) and a force applied to the valve body (10) and directed to the downstream side of the liquid flow path (7), an inner peripheral wall (31) of the cylinder (23) is provided with a plurality of short and shallow grooves (32) at a portion adjacent to a bottom wall (29) of the cylinder (23), said short and shallow grooves (32) running longitudinally, the inner peripheral wall (31) of the cylinder (23) is provided with an air intake port (123) communicating with an inside of the container, the piston (24) is formed with a pair of annular skirts (35, 37) held in close contact with the inner peripheral wall (31) of the cylinder (23), and a gap separating said pair of annular skirts is so selected that, when one of the annular skirts (35) rides on the short and shallow grooves (32) of the cylinder, the other of the annular skirts (37) is brought into close contact with inner peripheral wall of the cylinder at a position close to an open edge of the cylinder than the air intake port (123).

4. The trigger type liquid discharge device according to the claim 3, wherein a groove for the intake of an air is formed on the inner surface of the cylinder between a first position where the annular skirt (35) rides on the short and shallow groove (32) and a second further position which is near the air intake port relative to a third position where the annular skirt (37) is positioned when the piston is positioned at the approach end.

5. A trigger type liquid discharge device comprising a container, a pump unit having a cylinder and a piston, a discharge pipe (F) having a discharge aperture (405), and a trigger (102) for reciprocating the piston, wherein liquid drawn up from the container is discharged through the discharge aperture by movement of the piston to a stroke end, characterized in that a liquid guide (403) is arranged in a liquid flow path (407) disposed upstream relative to the discharge aperture (405), said liquid guide (403) comprising a valve body (410) for closing the liquid flow path (407), a pressure bearing sleeve (411) formed integrally with the valve body (410), a guide sleeve (417) connecting the valve body (410) and the pressure bearing sleeve (411) through an opening (420), the guide sleeve (417) of the liquid guide (403) is inserted into the inside of a guide sleeve(418) of a spin element (404), the valve body (410) is urged by a spring (413 between the guide sleeve (417) and a guide sleeve (418) to close the liquid flow path (407), said pressure bearing sleeve (411) has a pressure bearing surface (414) facing the upstream side of the liquid flow path (407) for bearing the liquid pressure, and an area of said pressure bearing surface (414) is so selected that a force generated by a proper liquid discharge pressure that is applied to said pressure bearing surface (411) is greater than sum of a resilient force of the spring member (413) and a force applied to the pressure bearing surface (414) and directed to the downstream side of the liquid flow path (407).

6. A trigger type liquid discharge device comprising a container, a pump unit having a cylinder and a piston, a discharge pipe (F) having a discharge aperture (5), and a trigger (102) for reciprocating the piston, wherein liquid drawn up from the container is discharged through the discharge aperture by movement of the piston to a stroke end, characterized in that said cylinder of the pump unit comprises an outer sleeve and an inner sleeve concentrically with the outer sleeve, a short and shallow groove is circumferentially provided on an outer surface of the inner sleeve at a position adjacent to a bottom wall of the outer sleeve, and said piston is provided with a skirt which closely contacts with the outer surface of the inner sleeve, and is so arranged that when the skirt is positioned in the short and shallow groove, the liquid flow path communicates to the inside of the container through a gap between the skirt and the short and shallow groove.

7. A trigger type liquid discharge device comprising a container, a pump unit having a cylinder and a piston, a discharge pipe (F) having a discharge aperture, and a trigger for reciprocating the piston, wherein liquid drawn up from the container is discharged through the discharge aperture by movement of the piston to a stroke end, characterized in that said bottom wall (97) of an inner sleeve (92) of the the cylinder (91) is formed with a hole (98) at a center thereof, said hole (98) communicating to an upper end of a liquid flow path (99), said liquid flow path (99) communicating to the container, short and shallow groove (301) is provided at a boundary between an outer surface of said inner sleeve (92) and a bottom wall (100) of the cylinder (91), an annular skirt (96) of the piston (93) is inserted into the short and shallow groove (301) upon the stroke end, so that a liquid flow path (303) communicates to the inside of the container through a gap between the inner surface of the piston (93) and the outer surface of the inner sleeve (92).

8. A trigger type liquid discharge device comprising a container, a pump unit having a cylinder and a piston, a discharge pipe (F) having a discharge aperture, and a trigger for reciprocating the piston, wherein liquid drawn up from the container is discharged through the discharge aperture by movement of the piston to a stroke end, characterized in that a hole (321) is formed at a center of a bottom wall (311) of the cylinder (310), the hole (321) communicates to a liquid flow path (319) which communicates to the inside of the container, the hole (321) is closed by a resilient valve (323) which resiliently contacts to an outer surface of the bottom wall (311), and a pin body (330) is provided at a center of the piston (312) toward the bottom wall (311) of the cylinder (310), and is so provided that when the piston (312) reaches at a stroke end, a front end (331) of the pin body (330) resiliently deforms the resilient valve (323) through the hole (321) so that a cylinder chamber (332) communicates to the liquid flow path (319).

9. The trigger type liquid discharge device according to the claim 2, wherein a liquid guide (403) is arranged in a liquid flow path (407) disposed upstream relative to the discharge aperture (405), said liquid guide (403) comprising a valve body (410) for closing the liquid flow path (407), a pressure bearing sleeve (411) formed integrally with the valve body, a guide sleeve (417) connecting the valve body (410) and the pressure bearing sleeve (411) through an opening (420), the guide sleeve (417) of the liquid guide (403) is slidably inserted into the inside of a guide sleeve (418) of a spin element (404), the valve body (410) is urged by a spring (413) between the guide sleeve (417) and a guide sleeve (418) to close the liquid flow path (407), and the pressure bearing sleeve (411) has an pressure bearing surface (414) facing the upstream side of the liquid flow path (407) for bearing the liquid pressure, an area of said pressure bearing surface (414) is so selected that a force generated by a proper liquid discharge pressure that is applied to said pressure bearing surface (411) is greater than sum of a resilient force of the spring member (413) and a force applied to the pressure bearing surface (414) and directed to the downstream side of the liquid flow path (407).

10. The trigger type liquid discharge device according to the claim 6, wherein a liquid guide (3) is arranged in a liquid flow path (7) disposed upstream relative to the discharge aperture (5), said liquid guide (3) comprising a valve body (10) for closing the liquid flow path (7), a pressure bearing sleeve (11) formed integrally with the valve body (10), an anchor member (12) to be secured to the discharge pipe, and a spring member (13) for coupling said integrally formed valve body (10) and the pressure bearing sleeve (11) with the anchoring member (12), said pressure bearing sleeve (11) has a pressure bearing surface (14) facing the upstream side of the liquid flow path (7) for bearing the liquid pressure, an area of said pressure bearing surface (14) is so selected that a force generated by a proper liquid discharge pressure that is applied to said pressure bearing surface (14) is greater than sum of a resilient force of the spring member (13) and a force applied to the valve body (10) and directed to the downstream side of the liquid flow path (7).

11. The trigger type liquid discharge device according to the claim 6, wherein a liquid guide (403) is arranged in a liquid flow path (407) disposed upstream relative to the discharge aperture (405), said liquid guide (403) comprising a valve body (410) for closing the liquid flow path (407), a pressure bearing sleeve (411) formed integrally with the valve body (410), a guide sleeve (417) connecting the valve body (410) and the pressure bearing sleeve (411) through an opening (420), the guide sleeve (417) of the liquid guide (403) is slidably inserted into the inside of a guide sleeve (418) of a spin element (404), the valve body (410) is urged by a spring (413) between the guide sleeve (417) and a guide sleeve (418) to close the liquid flow path (407), and an area of said pressure bearing surface (414) is so selected that a force generated by a proper liquid discharge pressure that is applied to said pressure bearing surface (411) is greater than sum of a resilient force of the spring member (413) and a force applied to the pressure bearing surface (414) and directed to the downstream side of the liquid flow path.

12. The trigger type liquid discharge device according to the claim 7, wherein a liquid guide (3) is arranged in a liquid flow path (7) disposed upstream relative to the discharge aperture (5), said liquid guide (3) comprising a valve body (10) for closing the liquid flow path (7), a pressure bearing sleeve (11) formed integrally with the valve body (10), an anchor member (12) to be secured to the discharge pipe, and a spring member (13) for coupling said integrally formed valve body (10) and the pressure bearing sleeve (11) width the anchoring member (12), said pressure bearing sleeve (11) has a pressure bearing surface (14) facing the upstream side of the liquid flow path (7) for bearing the liquid pressure, an area of said pressure bearing surface (14) is so selected that a force generated by a proper liquid discharge pressure that is applied to said pressure bearing surface (14) is greater than sum of a resilient force of the spring member (13) and a force applied to the valve body (10) and directed to the downstream side of the liquid flow path (7).

13. The trigger type liquid discharge device according to the claim 7, wherein a liquid guide (403) is arranged in a liquid flow path (407) disposed upstream relative to the discharge aperture (405), said liquid guide (408) comprising a valve body (410) for closing the liquid flow path (407), a pressure bearing sleeve (411) formed integrally with the valve body (410), a guide sleeve (417) connecting the valve body (410) and the pressure bearing sleeve (411) through an opening (420), the guide sleeve (417) of the liquid guide (403) is slidably inserted into the inside of a guide sleeve (418) of a spin element (404), the valve body (410) is urged by a spring (413) between the guide sleeve (417) and a guide sleeve (418) to close the liquid flow path (407), and said pressure bearing sleeve (411) has a pressure bearing surface (414) facing the upstream side of the liquid flow path (407) for bearing the liquid pressure, and an area of said pressure bearing surface (414) is so selected that a force generated by a proper liquid discharge pressure that is applied to said pressure bearing surface (411) is greater than sum of a resilient force of the spring member (413) and a force applied to the pressure bearing surface (414) and directed to the downstream side of the liquid flow path (407).

14. The trigger type liquid discharge device according to the claim 8, wherein a liquid guide (3) is arranged in a liquid flow path (7) disposed upstream relative to the discharge aperture (5), said liquid guide (3) comprising a valve body (10) for closing the liquid flow path (7), a pressure bearing sleeve (11) formed integrally with the valve body (10), an anchor member (12) to be secured to the discharge pipe, and a spring member (13) for coupling said integrally formed valve body (10) and the pressure bearing sleeve (11) with the anchoring member (12), said pressure bearing sleeve (11) has a pressure bearing surface (14,) facing the upstream side of the liquid flow path (7) for bearing the liquid pressure, an area of said pressure bearing surface (14) is so selected that a force generated by a proper liquid discharge pressure that is applied to said pressure bearing surface (14) is greater than sum of a resilient force of the spring member (13) and a force applied to the valve body (10) and directed to the downstream side of the liquid flow path (7).

15. The trigger type liquid discharge device according to the claim 8, wherein a liquid guide (403) is arranged in a liquid flow path (407) disposed upstream relative to the discharge aperture (405), said liquid guide (403) comprising a valve body (410) for closing the liquid flow path (407), a pressure bearing sleeve (411) formed integrally with the valve body (410), a guide sleeve (417) connecting the valve body (410) and the pressure bearing sleeve (411) through an opening (420), the guide sleeve (417) of the liquid guide (403) is slidably inserted into the inside of a guide sleeve (418) of a spin element (404), the liquid guide (403) is urged by a spring (413) between the guide sleeve (417) and a guide sleeve (418), and said pressure bearing sleeve (411) has a pressure bearing surface (414) facing the upstream side of the liquid flow path (407) for bearing the liquid pressure, and an area of said pressure bearing surface (414) is so selected that a force generated by a proper liquid discharge pressure that is applied to said pressure bearing surface (411) is greater than sum of a resilient force of the spring member (413) and a force applied to the pressure bearing surface (414) and directed to the downstream side of the liquid flow path (407).

* * * * *